US007706735B2

(12) United States Patent
Kishi

(10) Patent No.: US 7,706,735 B2
(45) Date of Patent: Apr. 27, 2010

(54) LUBRICANT APPLYING DEVICE AND IMAGE FORMING APPARATUS

(75) Inventor: Yoshiharu Kishi, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 11/949,413

(22) Filed: Dec. 3, 2007

(65) Prior Publication Data

US 2008/0131180 A1 Jun. 5, 2008

(30) Foreign Application Priority Data

Dec. 5, 2006 (JP) ..... 2006-328695

(51) Int. Cl.
*G03G 21/00* (2006.01)

(52) U.S. Cl. ..... 399/346

(58) Field of Classification Search ..... 399/123, 399/264, 345, 346
See application file for complete search history.

(56) References Cited

U.S. PATENT DOCUMENTS 5,870,650 A 2/1999 Takahashi et al.
6,035,157 A 3/2000 Takahashi et al.
6,741,821 B2 5/2004 Sugino et al.
6,785,500 B2 8/2004 Takahashi et al.
2001/0031411 A1* 10/2001 Kojima et al. ..... 430/58.05

FOREIGN PATENT DOCUMENTS

JP 5-323704 12/1993
JP 2002-268397 9/2002
JP 2002365973 A * 12/2002

* cited by examiner

*Primary Examiner*—David M Gray
*Assistant Examiner*—Billy J Lactaoen
(74) *Attorney, Agent, or Firm*—Oblon, Spivak, McClelland, Maier & Neustadt, L.L.P.

(57) ABSTRACT

A lubricant applying device includes a solid lubricant and a roller brush that rotates while in contact with the lubricant, receives the lubricant, and applies the lubricant to an image carrier. A corner portion of the lubricant on an upstream side with respect to direction of rotation of the roller brush is convex, i.e., blunt.

12 Claims, 8 Drawing Sheets

$$SF1 = \frac{(MXLNG)^2}{AREA} \times \frac{\pi}{4} \times 100$$

$$SF2 = \frac{(PERI)^2}{AREA} \times \frac{1}{4\pi} \times 100$$

LUBRICANT APPLYING DEVICE AND IMAGE FORMING APPARATUS

CROSS-REFERENCE TO RELATED APPLICATIONS

The present application claims priority to and incorporates by reference the entire contents of Japanese priority document 2006-328695 filed in Japan on Dec. 5, 2006.

BACKGROUND OF THE INVENTION

1. Field of the Invention

The present invention relates to a lubricant applying device in an image forming apparatus.

2. Description of the Related Art

Image forming apparatuses, such as copying machines, facsimile machines, and printers, generally include a photosensitive drum and an intermediate transfer member. The photosensitive drum and the intermediate transfer member serve as image carriers. Japanese Patent Application Laid-Open No. H05-323704, for example, discloses a conventional image forming apparatus including a photosensitive drum and an intermediate transfer member.

Two types of image forming apparatuses are popular in the marketplace. In the first type a photosensitive drum serves as an image carrier, and in the second type an intermediate transfer member and a photosensitive drum together serve as an image carrier.

In the first type, the photosensitive drum is normally in the form of a drum or a belt. The photosensitive drum rotates in a predetermined direction, and discharge process, exposure process, and developing process are performed with respect to the rotating photosensitive drum thereby forming a toner image onto the photosensitive drum. Transfer process is performed with respect to the toner image on the photosensitive drum thereby transferring the toner image onto a recording medium. The recording medium can be an intermediate transfer member or a paper.

On the other hand, in the second type, both the photosensitive drum and the intermediate transfer member are normally in the form of a drum or a belt. A toner image is formed in the same manner as the first type on the photosensitive drum in accordance with rotation of the intermediate transfer member in a predetermined direction. The toner image is first transferred from the photosensitive drums to the intermediate transfer member by a primary transfer process, and then the toner image is transferred from the intermediate transfer member to a recording medium by a secondary transfer process. The recording medium can be a paper.

In both the first type and the second type, once the transfer of the toner image is complete, wastes including residual toners or paper powders that remain on the photosensitive drum or the intermediate transfer member are removed by performing cleaning process with a cleaning unit.

A cleaning blade is widely used as a cleaning unit. The cleaning blade is arranged to make a physical contact with a rotating image carrier so as to scrape wastes from the surface of the image carrier. Such a cleaning blade is generally made of rubber, realizing a cheaper and simpler structure with better cleaning performance. Sometimes a brush roller that can electrostatically remove wastes is used.

A higher image quality can be achieved if the toner particles are spherical and minute. In order to satisfy the recent increasing demand for achieving higher image quality, toners with perfectly spherical and minute toner particles are being used. It is difficult, however, to remove wastes that contain such perfectly spherical and minute toner particles with the conventional cleaning blades or brush rollers.

For example, polymerized toner, such as SPR-C toner, is increasingly used in the image forming apparatus for achieving higher image quality. However, the SPR-C toner contains uniformly distributed wax material, so that the wax material is not sufficiently deposited onto the image carrier when the toner sticks to the image carrier. If the wax material that is deposited is insufficient, coefficient of friction of the surface of the image carrier increases as the time elapses. Moreover, cleaning performance decreases as the coefficient of friction increases.

Furthermore, toners with ultra-fine particles are being used for achieving higher image quality. However, ultra-fine particles are more likely to pass through even smaller gaps, slits, or holes in the cleaning blade or the brush roller. Specifically, when dimensional accuracy or assembly accuracy of the cleaning blade or the brush roller is less, or when vibration occurs on a portion of the cleaning blade or the brush roller, more toner particles pass through gaps, slits, or holes in the cleaning blade or the brush roller. Thus, cleaning performance decreases.

Because the cleaning blade is in physical contact with the image carrier, friction occurs between the two. Such friction result into abrasion of the cleaning blade and the image carrier thereby reducing the lifetimes of the cleaning blade and the image carrier. Furthermore, the cleaning blade may bend if the coefficient of friction is too high. Bending of the cleaning blade may stop certain functions of the image forming apparatus, or cause failure of the entire image forming apparatus.

For lengthening the lifetime of the image carrier and maintaining higher image quality, it is necessary to suppress damage of the image carrier, the cleaning blade, and to improve the cleaning performance. Moreover, it is necessary to prevent filming that is another cause of degradation of image quality. Filming is the phenomenon in which toners get firmly stuck onto the surface of the image carrier due to various reasons such as pressing force, and heat generated because of the friction between the cleaning blade and the image carrier.

In one of the conventional techniques, a lubricant is applied onto the image carrier for improving the cleaning performance and preventing filming.

It is necessary to stably apply an appropriate amount of the lubricant to the image carrier. If the applied lubricant is too much, coefficient of friction of the surface of the image carrier excessively decreases, decreasing amount of toners held on the image carrier. As a result, an undesirable image, such as a so-called moth eaten image, may be formed. On the other hand, if the applied lubricant is too less, coefficient of friction increases, resulting in damage to the parts.

Various techniques are known for adjusting the amount of the applied lubricant. For example, for adjusting the amount of the applied lubricant pressure between the lubricant and the brush roller can be adjusted, rotation speed of the brush roller can be adjusted, or hardness of the brush roller can be adjusted.

It is also known that amount of the lubricant applied varies depending on the state of the lubricant being in contact with the brush roller. For example, if the lubricant applied on the image carrier has corners or bumps, where the brush roller can eat into, consumption of the lubricant largely increases compared to when the brush roller slides smoothly over the surface of the lubricant. When the bumps in the lubricant become flat over time because they are scrapped off by the brush roller, the amount of applied lubricant largely decreases. There are reports that the decrease of the amount of the lubricant to be applied after using the lubricant was one tenth of that at the time of beginning of use of the lubricant.

On the other hand, if the brush roller eats in the lubricant, rotational torque of the brush roller increases. Furthermore, such a brush roller is left as it is for a long time, hairs of the brush roller may be become angled.

Thus, it is not preferable that the lubricant applied on the image carrier has corners or bumps.

When the lubricant is applied onto the image carrier by rotating the brush roller in a predetermined direction, the lubricant may be slid to a down stream side in the predetermined direction due to rotation of the brush roller, and may generate corners or bumps into which the brush roller can eat into. In consideration of above situation, Japanese Patent Application Laid-Open No. 2002-268397 discloses a conventional technology for previously shifting a position of the lubricant to the upstream side in a rotation direction of the brush roller.

According to the conventional technology, such a situation where the brush roller eats into the corners or the bumps of the lubricant occurs due to defects in the mechanism for holding the lubricant. Such a mechanism generally includes a first member for holding the lubricant, a second member for guiding the lubricant on the first member to come into contact with or away from the brush roller, and a third member arranged between the first member and the second member to bias the lubricant toward the brush roller. A gap is kept between the first member and the second member. Such gap is useful if there is a need to change a position of the first member depending on a position of the second member. The gap also functions as a buffer for dimensional error. Moreover, it is easy to assemble the first member and the third member when the gap is present. Because of the gap, however, the lubricant comes into contact with the brush roller when the brush roller rotates, so that the first member inclines toward the second member. As a result, the lubricant also inclines toward the brush roller.

In other words, it is difficult to avoid eating of the brush roller into corners or bumps of the lubricant. The conventional technology, therefore, proposes to previously shift any one of the first member to the third member to the upstream side in the rotation direction of the brush roller thereby shifting a position of applying the lubricant to the upstream side.

However, the amount of such shift will vary depending on dimensional error or assembly accuracy of the first member to the third member. In other words, the amount of the shift must be adjusted depending on the situation or the brush roller may eat into the corners or the bumps even when the position of the lubricant is shifted.

Furthermore, if the shift is excessively large, the brush roller fails to come into contact with some portions of the lubricant, so that use efficiency of the lubricant decreases, resulting in loss of the lubricant. As a result, economic efficiency decreases, and lifetimes of the lubricant and the image forming apparatus is shortened. Thus, use efficiency of the lubricant may be degraded even when a position of the lubricant is shifted.

SUMMARY OF THE INVENTION

It is an object of the present invention to at least partially solve the problems in the conventional technology.

According to an aspect of the present invention, there is provided a lubricant applying device for use in an image forming apparatus that includes a lubricant in a solid form and to be coated on an image carrier of the image forming apparatus; and a rotating member that rotates while in contact with the lubricant, receives the lubricant, and applies the lubricant to the image carrier. The lubricant having an upstream side and a downstream side with respect to direction of rotation of the rotating member, and a corner portion of the upstream side of the lubricant is convex.

According to another aspect of the present invention, there is provided a lubricant applying device for use in an image forming apparatus that includes a lubricant in a solid form and to be coated on an image carrier of the image forming apparatus; and a rotating member that rotates while in contact with the lubricant, receives the lubricant, and applies the lubricant to the image carrier. A corner portion of the lubricant that is closest to the rotating unit is convex.

According to still another aspect of the present invention, there is provided an image forming apparatus including an image carrier for carrying an image; a lubricant in a solid form and to be coated on the image carrier; and a rotating member that rotates while in contact with the lubricant, receives the lubricant, and applies the lubricant to the image carrier. The lubricant having an upstream side and a downstream side with respect to direction of rotation of the rotating member, and a corner portion of the upstream side of the lubricant is convex.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
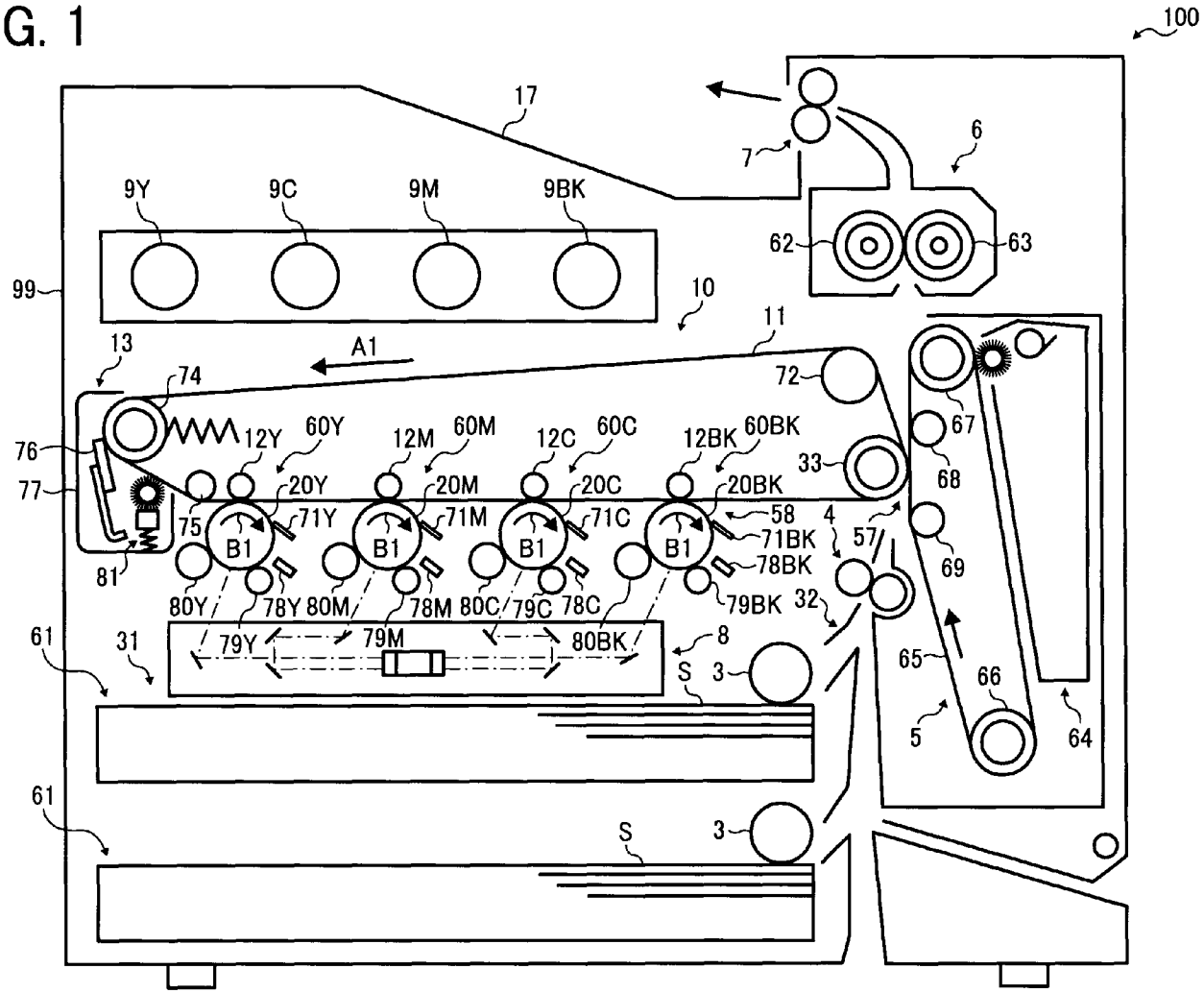
FIG. 1 is a schematic diagram of an image forming apparatus according to an embodiment of the present invention.

FIG. 1 is a schematic diagram of an image forming apparatus 100 according to an embodiment of the present invention. The image forming apparatus 100 shown in FIG. 1 is a color laser printer; however, the image forming apparatus 100 is not limited to a color laser printer. In other words, the image forming apparatus 100 can be a printer, a facsimile machine, a copier, or a multifunction product.

The image forming apparatus 100 performs image forming process by using an image signal corresponding to image data received from external devices. The image forming apparatus 100 forms an image on a sheet recording medium including papers generally used in copiers, overhead projector (OHP) sheets, cardboards including cards and postcards, envelopes, and the like.

The image forming apparatus 100 is a tandem type. In other words, photosensitive drums 20Y, 20M, 20C, 20BK that are latent image carriers are aligned in parallel to one another. The photosensitive drums 20Y, 20M, 20C, and 20BK are configured to form images for four different colors: yellow, magenta, cyan, and black (Y, M, C and BK). Each of reference codes Y, M, C, and BK means that each of members with the codes serves for forming an image in corresponding color.

The photosensitive drums 20Y, 20M, 20C, 20BK, which serve as surface moving members, are rotatably supported by a frame (not shown) of an apparatus body 99 of the image forming apparatus 100, and are arranged in that order in a direction (counterclockwise direction) represented by A1 as shown in FIG. 1, which is a moving direction of a transfer belt 11.

The photosensitive drums 20Y, 20M, 20C, and 20BK are included in image forming units 60Y, 60M, 60C, and 60BK, respectively. Each of the image forming units 60Y, 60M, 60C, and 60BK forms a monochrome image by using each corresponding color Y, M, C, and BK.

The photosensitive drums 20Y, 20M, 20C, and 20BK are arranged on outer circumference of the transfer belt 11, i.e., a side on which an image is to be formed. The transfer belt 11 is an intermediate transfer member as an image carrier configured as an endless belt arranged in a central part in the apparatus body 99.

The transfer belt 11 is movable in a direction represented by an arrow A1 as shown in FIG. 1, and contacts the photosensitive drums 20Y, 20M, 20C, and 20BK. Toner images are formed on each of the photosensitive drums 20Y, 20M, 20C, and 20BK, and sequentially superimposed one upon another onto the transfer belt 11 moving in the direction represented by the arrow A1, so that a full-color image is generated. The full-color image is then transferred onto a transfer sheet S as a recording medium. As described above, the image forming apparatus 100 is an intermediate transfer type.

The transfer belt 11 is arranged in such a manner that lower portion of the transfer belt 11 comes contact with the photosensitive drums 20Y, 20M, 20C, and 20BK, so that contact portion serves as a primary transfer member 58 that transfers toner images formed on the photosensitive drums 20Y, 20M, 20C, and 20BK onto the transfer belt 11.

Primary transfer rollers 12Y, 12M, 12C, and 12BK are arranged adjacent to the photosensitive drums 20Y, 20M, 20C, and 20BK along inner circumference of the transfer belt 11. Toner images formed on the photosensitive drums 20Y, 20M, 20C, and 20BK are sequentially superimposed one upon another onto a same position of the transfer belt 11 by applying voltage at different timings by using the primary transfer rollers 12Y, 12M, 12C, and 12BK in accordance with movement of the transfer belt 11 in the direction represented by the arrow A1.

The transfer belt 11 has multilayer structure in which a coating layer is deposited on a base layer. The base layer is made of material with less elasticity. The coating layer is made of smooth material and coats the surface of the base layer. The base layer can be made of such materials as fluorine resin, physical vapor deposition (PVD) sheet, and polyimide resin. The coating layer can be made of fluorine resin.

The transfer belt 11 includes a drift prevention guide (not shown) serving as a drift prevention member on its corner portions. The drift prevention guide is operative to prevent drifting of the transfer belt 11 in a direction orthogonal to the moving direction represented by the arrow A1 upon rotating the transfer belt 11. The drift prevention guide is made of rubber such as polyurethane rubber or silicon rubber.

The image forming apparatus 100 includes a transfer belt unit 10, a secondary transfer device 5, and an optical scanning device 8 all housed in the apparatus body 99. The transfer belt unit 10 serves as an intermediate transfer unit including the transfer belt 11, and is located above the image forming units 60Y, 60M, 60C, 60BK. The secondary transfer device 5 is located on the right side of the transfer belt 11 as shown in FIG. 1. The optical scanning device 8 is an exposure device that serves as an optical writing unit as a latent-image forming unit arranged below the image forming units 60Y, 60M, 60C, 60BK.

The image forming apparatus 100 also includes a sheet feeding unit 61, the secondary transfer device 5, a pair of registration rollers 4, and a sensor (not shown) all housed in the apparatus body 99. The sheet feeding unit 61 is a sheet feeding cassette in which stack of transfer sheets S to be fed to a secondary transfer unit 57 arranged between the transfer belt 11 and the secondary transfer device 5 can be set. The registration rollers 4 send the transfer sheet S fed from the sheet feeding unit 61 to the secondary transfer unit 57 at a predetermined timing corresponding to a timing of forming of a toner image by each of the image forming units 60Y, 60M, 60C, and 60BK. The sensor (not shown) detects that the front end of the transfer sheet S reaches the registration rollers 4.

The image forming apparatus 100 also includes a fuser 6, a discharge roller 7, toner bottles 9Y, 9M, 9C, 9BK, and a sheet-discharge tray 17 all housed in the apparatus body 99. The fuser 6 is a roller-type fixing unit for fusing the toner image onto the transfer sheet S. The discharge roller 7 discharges the transfer sheet S with the toner image fixed to the outside of the apparatus body 99. The toner bottles 9Y, 9M, 9C, 9BK are located above the transfer belt unit 10 and filled with toners of yellow, magenta, cyan, black, respectively. The sheet-discharge tray 17 is arranged on the top surface of the apparatus body 99 and on which the transfer sheet S is discharged by the discharge roller 7.

The image forming apparatus 100 also includes a cleaning device 64, a driving device (not shown), and a control unit (not shown). The cleaning device 64 cleans the secondary transfer device 5. The driving device rotates the photosensitive drums 20Y, 20M, 20C, and 20BK. The control unit includes a central processing unit (CPU) (not shown) and a memory (not shown), and controls the image forming apparatus 100.

The transfer belt unit 10 includes the primary transfer rollers 12Y, 12M, 12C, 12BK, a drive roller 72, a cleaning counter roller 74, tension rollers 75, 33, and a cleaning device 13. The primary transfer rollers 12Y, 12M, 12C, 12BK serve as primary-transfer bias rollers. The drive roller 72 is a driving member around which the transfer belt 11 is extended. The cleaning counter roller 74 serves as a tension roller. The tension rollers 75, 33 serve as support rollers that extend the transfer belt 11 in association with the drive roller 72 and the cleaning counter roller 74. The cleaning device 13 is a belt cleaning device serving as an intermediate-transfer-member cleaning device that removes wastes from the surface of the transfer belt 11, and arranged in a position between the cleaning counter roller 74 and the tension roller 75 along outer circumference of the transfer belt 11.

The transfer belt unit 10 includes a driving system (not shown), a power source (not shown), and a control unit (not shown). The driving system drives the drive roller 72. The power source and the control unit serve as a bias applying unit (not shown) that applies primary transfer bias onto the primary transfer rollers 12Y, 12M, 12C, and 12BK.

The cleaning counter roller 74, and the tension rollers 75, 33 are driven rollers that are driven in accordance with the transfer belt 11 rotated by the drive roller 72. The primary transfer rollers 12Y, 12M, 12C, and 12BK press the transfer belt 11 from a surface of an inner circumference of the transfer belt 11 toward the photosensitive drums 20Y, 20M, 20C, and 20BK, defining a primary transfer nips. The primary transfer nips are defined on the transfer belt 11 extended between the tension rollers 75 and 33. The tension rollers 75 and 33 have functions for stabilizing the primary transfer nip.

Primary-transfer electric field is generated due to the primary transfer bias at the primary transfer nips between the photosensitive drums 20Y, 20M, 20C, 20BK and the primary transfer rollers 12Y, 12M, 12C, 12BK, respectively. The toner images formed on the photosensitive drums 20Y, 20M, 20C, 20BK are primarily transferred onto the transfer belt 11 due to the primary-transfer electric field and nip pressure.

The tension roller 33 is in contact with the secondary transfer device 5 via the transfer belt 11. The tension roller 33 is a part of the secondary transfer unit 57.

The cleaning counter roller 74 has a function of a tension roller serving as a pressurizing member that applies a predetermined tension suitable for transferring to the transfer belt 11.

The cleaning device 13 is located substantially between the cleaning counter roller 74 and the tension roller 75 as shown in FIG. 1. The cleaning device 13 includes a cleaning blade 76 and a lubricant applying device 81 housed in a case 77. The cleaning blade 76 is arranged in contact with the transfer belt 11 at a position opposite to the cleaning counter roller 74. The lubricant applying device 81 serves as a lubricant applying unit arranged in contact with the transfer belt at downstream from the cleaning blade 76 in the direction represented by A1 shown in FIG. 1.

The cleaning blade 76 removes wastes, such as toner, from the surface of the transfer belt 11 thereby cleaning the transfer belt 11. Details of the cleaning device 13, specifically, the lubricant applying device 81 will be described later.

The sheet feeding units 61 accommodate a bulk of the transfer sheets S, and are arranged in a multistage arrangement below the optical scanning device 8, which is at a bottom portion of the apparatus body 99, thus serving as a paper bank 31.

The sheet feeding unit 61 includes a feed roller 3 to be pressed onto the surface of a transfer sheet S on the top of the bulk of transfer sheets S, and feeds the transfer sheet S toward the registration rollers 4 upon rotating the feed roller 3 at a predetermined timing in a counterclockwise direction.

The transfer sheet S fed from the sheet feeding unit 61 reaches the registration rollers 4 via a sheet feed path 32, and is sandwiched by the registration rollers 4.

The secondary transfer device 5 is arranged to face the tension roller 33, and includes a secondary transfer belt 65 and rollers 66, 67, 68, 69. The secondary transfer belt 65 is an endless belt arranged in contact with the transfer belt 11 at a position opposite to the tension roller 33, and extended around the rollers 66, 67, 68, 69. The roller 67 serves as a drive roller while the rollers 66, 68, 69 serve as driven rollers, so that the secondary transfer belt 65 is rotated in a direction represented by an arrow shown in FIG. 1 by rotation of the drive roller 67 and the driven rollers 66, 68, 69.

The secondary transfer belt 65 is pressed toward the tension roller 33 via the transfer belt 11 at a position between the rollers 68 and 69, so that the toner image on the transfer belt 11 is transferred onto the transfer sheet S at this position.

Figure 2:
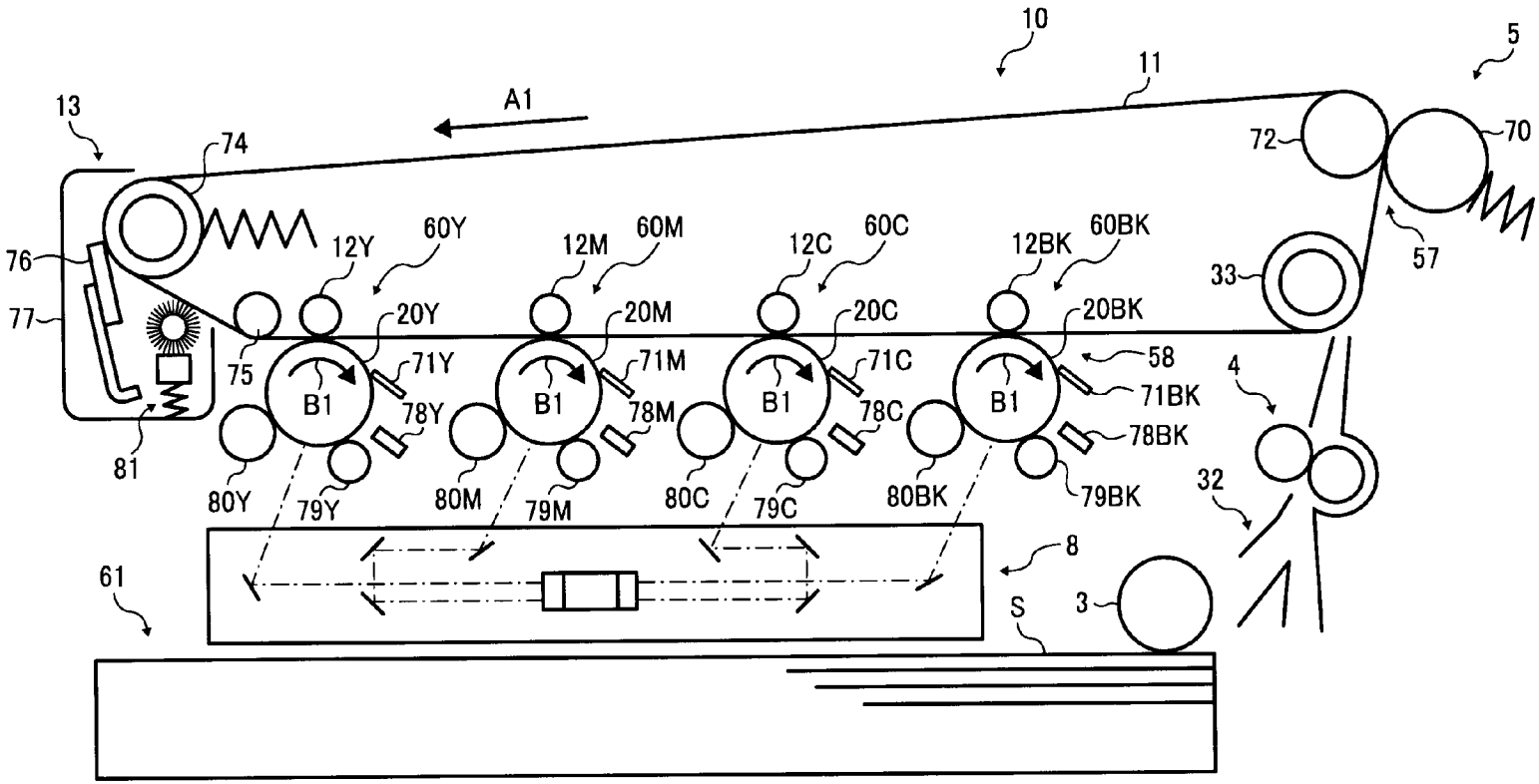
FIG. 2 is a schematic diagram of modification of a secondary transfer device shown in FIG. 1.

The secondary transfer device 5 performs a sheet feeding function for feeding the transfer sheet S to the fuser 6 after the toner image is transferred onto the transfer sheet S. As the secondary transfer device 5, a transfer roller 70 shown in FIG. 2 and a noncontact charger (not shown) can be used. However, it is preferable to use the secondary transfer device 5 with a configuration shown in FIG. 1 in that it includes the sheet feeding function. If the transfer roller 70 is used as the secondary transfer device 5, the drive roller 72 also serves as a secondary transfer counter roller.

The cleaning device 64 removes wastes, such as paper pieces or toner, from the secondary transfer belt 65 at a position being in contact with the roller 67, thereby cleaning the secondary transfer belt 65.

The fuser 6 is located above the secondary transfer device 5, and includes a heating roller 62 and a pressurizing roller 63. The heating roller 62 serves as a fixing roller and includes a heat source inside the heating roller 62, while the pressurizing roller 63 is in contact with the heating roller 62 by pressure.

The fuser 6 fixes the toner image onto the transfer sheet S due to heat and pressure upon feeding the transfer sheet S with the toner image through a fixing member that is a portion where the heating roller 62 comes contact with the pressurizing roller 63 by pressure.

Four color toners of yellow, magenta, cyan, black are filled in the toner bottles 9Y, 9M, 9C, 9BK, respectively. These toners are polymerized toner, and predetermined amount of the toners are supplied from the toner bottles 9Y, 9M, 9C, 9BK to developing devices 80Y, 80M, 80C, 80BK installed in the image forming units 60Y, 60M, 60C, 60BK through a feed path (not shown).

The image forming units 60Y, 60M, 60C, 60BK are configured in the same manner. The image forming units 60Y, 60M, 60C, 60BK include the primary transfer rollers 12Y, 12M, 12C, 12BK, cleaning devices 71Y, 71M, 71C, 71BK, neutralizing devices 78Y, 78M, 78C, 78BK, charging devices 79Y, 79M, 79C, 79BK, and the developing devices 80Y, 80M, 80C, 80BK, along a rotation direction (clockwise direction) represented by B1 shown in FIG. 1 around the photosensitive drums 20Y, 20M, 20C, 20BK, respectively. The cleaning devices 71Y, 71M, 71C, 71BK serve as cleaning units. The neutralizing devices 78Y, 78M, 78C, 78BK serve as neutralizing units. The charging devices 79Y, 79M, 79C, 79BK serve as charging units that charges alternating current (AC). The developing devices 80Y, 80M, 80C, 80BK serve as developing units that develop images by binary developer.

When a signal indicative of formation of a color image is input to the image forming apparatus 100, the drive roller 72 is driven, so that the transfer belt 11, the cleaning counter roller 74, and the tension rollers 75, 33 are driven in accordance with the drive roller 72, and the photosensitive drums 20Y, 20M, 20C, 20BK are rotated in the direction B1.

During rotation of the photosensitive drums 20Y, 20M, 20C, 20BK in the direction B1, the surfaces of the photosensitive drums 20Y, 20M, 20C, 20BK are uniformly charged by the charging devices 79Y, 79M, 79C, 79BK, respectively. Exposure scanning is then performed by using laser beam output from the optical scanning device 8, so that monochrome latent images of yellow, magenta, cyan, black are formed onto the photosensitive drums 20Y, 20M, 20C, 20BK, respectively. The latent images are then developed by the developing devices 80Y, 80M, 80C, 80BK by using toners of yellow, magenta, cyan, black, so that monochrome color images are formed for each color.

The toner images of yellow, magenta, cyan, black formed by developing are sequentially transferred by the primary transfer rollers 12Y, 12M, 12C, 12BK onto the same position of the transfer belt 11 rotating in the direction A1 as shown in FIG. 1. As a result, a superimposed color image is formed on the transfer belt 11.

In accordance with input of the signal indicative of formation of a color image, one of the sheet feeding devices 61 installed in the paper bank 31 is selected, so that transfer sheet S are sequentially output from the selected sheet feeding unit 61 by rotation of the sheet feed roller 3. The transfer sheets S are fed to the sheet feed path 32 one by one. The transfer sheet S fed into the sheet feed path 32 is further transferred by a feed roller (not shown), and stops in such a manner that the top end of the transfer sheet S comes contact with the registration rollers 4.

The registration rollers 4 rotate in accordance with a timing of moving the superimposed color image on the transfer belt 11 to the secondary transfer unit 57 due to rotation of the transfer belt 11 in the direction represented A1 as shown in FIG. 1. The superimposed color image is transferred onto the transfer sheet S fed to the secondary transfer unit 57, and then transferred and recorded onto the transfer sheet S due to action of nip pressure in the secondary transfer unit 57.

The transfer sheet S is fed to the fuser 6 by the secondary transfer device 5. When the transfer sheet S passes through a fixing member between the heating roller 62 and the pressurizing roller 63 in the fuser 6, the toner image, i.e., the superimposed color image, is fixed onto the transfer sheet S due to heat and pressure.

After the superimposed color image is fixed by the fuser 6, the transfer sheet S is discharged to the outside of the apparatus body 99 via the discharge roller 7, and stacked on the sheet-discharge tray 17.

The cleaning devices 71Y, 71M, 71C, 71BK remove residual toner remaining on the photosensitive drums 20Y, 20M, 20C, 20BK after the photosensitive drums 20Y, 20M, 20C, 20BK transfer toner images. The neutralizing devices 78Y, 78M, 78C, 78BK neutralizes the photosensitive drums 20Y, 20M, 20C, 20BK, making them be ready for next charging performed by the charging devices 79Y, 79M, 79C, 79BK.

After the transfer belt 11 passes through the secondary transfer unit 57 that has finished secondary transfer, the cleaning device 13 cleans the surface of the transfer belt 11 so that the transfer belt 11 is ready for next transfer.

Because a cleaning blade is used in the cleaning device 13, stress due to friction between the surface of the image carrier and the cleaning blade is large, causing abrasion of the cleaning blade and the image carrier. Such abrasion can damage the image carrier and the cleaning blade, and can be a cause of bending of the cleaning blade. For lengthening lifetime of the image carrier and maintaining high quality in image for a long time, it is necessary to suppress damage of the image carrier, the cleaning blade, and to improve the cleaning performance. Furthermore, it is necessary to prevent the filming.

For improving the cleaning performance and preventing the filming, in the image forming apparatus 100, lubricant is applied on the surface of the image carrier. Specifically, the image forming apparatus 100 includes the lubricant applying device 81 in the cleaning device 13 for applying lubricant on the surface of the image carrier.

Figure 3A:
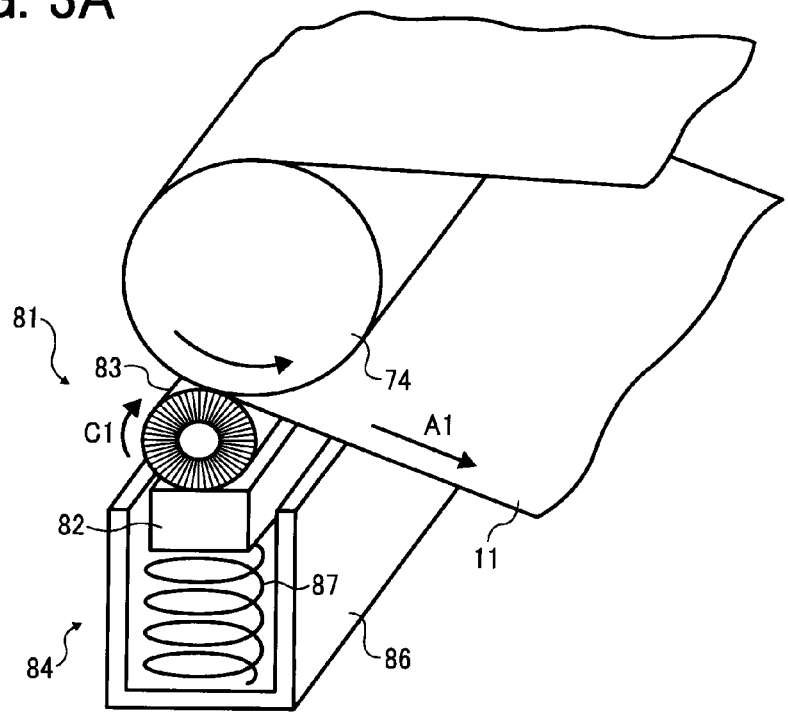
FIG. 3A is a perspective view of a lubricant applying device shown in FIG. 1.
Figure 3B:
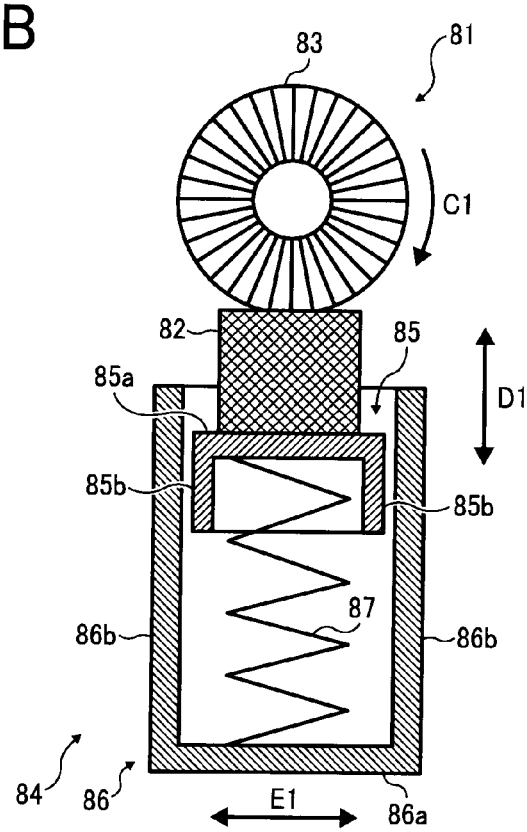
FIG. 3B is a cross sectional view of the lubricant applying device shown in FIG. 3A.

As shown in FIGS. 3A and 3B, the lubricant applying device 81 includes lubricant 82, a brush roller 83, a holding member 84, and a driving unit (not shown). The lubricant 82 is a columnar solid having a curved top surface in a cross section as shown in FIG. 3B. The brush roller 83 is in contact with the transfer belt 11 and serves as an applying member that applies the lubricant 82 onto the transfer belt 11. The holding member 84 holds the lubricant 82. The driving unit rotates the brush roller 83 in a direction represented by C1 as shown in FIGS. 3A and 3B.

The holding member 84 includes a supporting member 85, a guide member 86, and a spring 87. The supporting member 85 supports the bottom portion of the lubricant 82, which is a side surface opposite to the surface facing the brush roller 83. The guide member 86 guides the supporting member 85 to come into contact with or away from the brush roller 83. The spring 87 is a compression spring serving as an elastic member that pushes the lubricant 82 toward the brush roller 83. The supporting member 85 is not shown in FIG. 3A for convenience of drawing.

The brush roller 83 is extended in a direction of width of the transfer belt 11, i.e., a main scanning direction, and is slidably in contact with the surface of the transfer belt 11 along the main scanning direction. The direction represented by C1 shown in FIGS. 3A and 3B corresponds to the direction represented by A1 at a contact point of the transfer belt 11 and the brush roller 83.

The lubricant 82 is extended along the brush roller 83, i.e., the main scanning direction, and its surface is in contact with the brush roller 83 due to bias force of the spring 87 along the main scanning direction.

The lubricant 82 is operative to decrease the coefficient of friction between the surface of the transfer belt 11 and substances that are in contact with the surface of the transfer belt 11. The substances are, for example, toners, magnetic carriers contained in the developer in addition to toner, or the cleaning blade 76. The lubricant 82 contains zinc stearate; however, it can contain other substances such as fatty acid metallic salt or metallic soup.

As shown in FIG. 3B, the supporting member 85 is extended in the main scanning direction, and has an open bracket shape when viewed from a cross section in a direction orthogonal to the main scanning direction. The supporting member 85 includes a bottom portion 85*a* and side portions 85*b*. The bottom portion 85*a* supports the bottom portion of the lubricant 82 at the top surface of the bottom portion 85*a*. The side portions 85*b* are arranged in such a manner that they are orthogonally connected to the bottom portion 85*a* toward a direction opposite to the brush roller 83. An end portion of the spring 87 is in contact with a back surface of the bottom portion 85*a*.

The guide member 86 is extended in the main scanning direction and has an open bracket shape in a cross section in a direction orthogonal to the main scanning direction. The guide member 86 includes a bottom portion 86*a* and side portions 86*b*. The bottom portion 86*a* is in contact with the other end portion of the spring 87, thereby supporting the spring 87. The side portions 86*b* are arranged in such a manner that they are orthogonally connected to the bottom portion 86*a* toward the brush roller 83 and in parallel to the side portions 85*b*.

The side portions 86*b* face each other in such a manner that outer surfaces of the side portions 85*b* are in contact with or in close contact with inner surfaces of the side portions 86*b*. The guide member 86 guides the supporting member 85 to move upward and downward due to the biasing force of the spring 87.

The guide member 86 guides the supporting member 85 to come into contact with or away from the brush roller 83 in a manner described above. It is sufficient that the guide member 86 guides the supporting member 85 in a direction toward a rotation center of the brush roller 83, and it is not necessary to guide the supporting member 85 in the shortest distance.

The lubricant 82 shown in FIG. 3B is in a usual position toward the brush roller 83. It means that the lubricant 82 comes into contact with the brush roller 83 in a direction toward the rotation center of the brush roller 83. In other words, that direction corresponds to a direction toward which the spring 87 biases the lubricant 82, i.e., a direction toward which the guide member 86 guides the supporting member 85, and is represented by an arrow D1 as shown in FIG. 3B.

Assume now that a direction orthogonal to the direction represented by D1 shown in FIG. 3B and parallel to the direction C1 shown in FIG. 3B at a position where the lubricant 82 and the brush roller 83 come into contact with each other is E1. Each of the lubricant 82, the supporting member 85, and the guide member 86 is symmetrically arranged to the direction D1 in a state where external force is not applied to the lubricant 82 and the bottom portion 86*a* is placed on a horizontal plane.

Shape of the spring 87 is also arranged in a substantially symmetric manner to the direction D1, where the spring 87 is operative in a dynamically symmetric manner.

In FIGS. 3A and 3B the supporting member 85 is shown to be wider than the lubricant 82; however, in practice the supporting member 85 and the lubricant 82 have almost the same widths.

The lubricant applying device 81 scoops the lubricant 82 with the rotating brush roller 83, and applies the scooped lubricant 82 onto the surface of the transfer belt 11. Specifically, the brush roller 83 scoops the solid lubricant 82 by sliding over the lubricant 82. Upon being scooped, the lubricant 82 is turned into fine powders and attached to the brush roller 83. The lubricant 82 in fine powder form is delivered to an area facing the transfer belt 11 in accordance with rotation of the brush roller 83, and then supplied onto the surface of the transfer belt 11.

By applying the lubricant 82 onto the surface of the transfer belt 11, it is possible to reduce mechanical stress applied to the transfer belt 11 and the cleaning blade 76 during a process of forming an image, and protect the transfer belt 11 from discharge due to AC charging. As a result, lifetimes of the transfer belt 11 and the cleaning blade 76 can be lengthened. Thus, cleaning performance can be maintained in desired performance for a long time, and filming can be prevented or suppressed.

The lubricant 82 applied to the transfer belt 11 is spread by the cleaning blade 76 when the cleaning blade 76 removes residual toners, so that a film made of the lubricant is formed on the transfer belt 11. However, it is possible to arrange a blade used exclusively for spreading the lubricant 82 on the transfer belt 11 on a downstream side of the brush roller 83 along the direction A1 as shown in FIG. 3A.

As described above, it is necessary to stably apply an appropriate amount of the lubricant to the image carrier. If the applied lubricant is too much, coefficient of friction of the surface of the image carrier excessively decreases, so that amount of toners held on the image carrier decreases. As a result, an undesirable image, such as a so-called moth eaten image, may be formed. On the other hand, if the applied lubricant is to less, coefficient of friction increases, resulting in causing damage to the parts.

For adjusting amount of lubricant to be applied, a method of adjusting application pressure between the lubricant and the brush roller, adjusting rotation frequency of the brush roller, and adjusting hardness of the brush roller are employed in a mechanism of applying the lubricant by using the brush roller as in the image forming apparatus 100.

On the other hand, amount of lubricant to be applied varies depending on the state of the lubricant being in contact with the brush roller.

Figure 10:
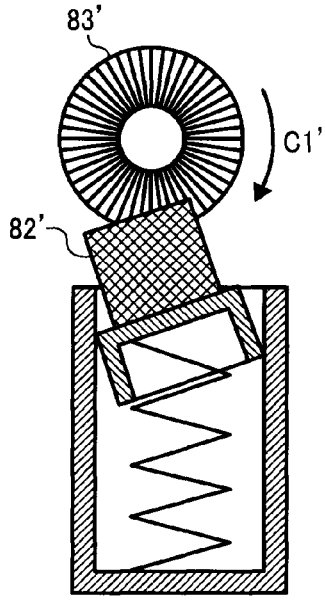
FIG. 10 is a cross sectional view for explaining a state where a brush roller eats into a lubricant.
Figure 11:
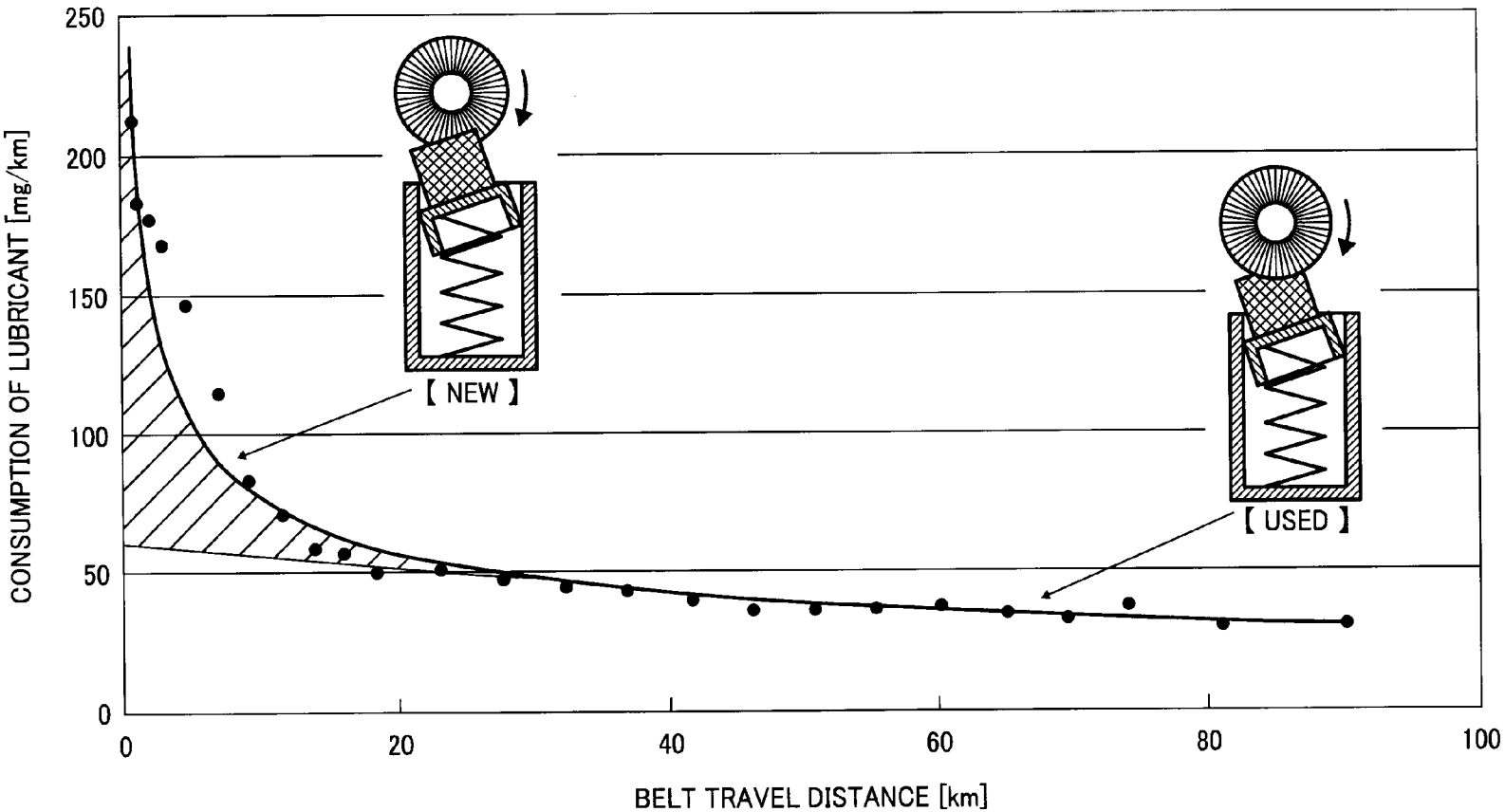
FIG. 11 is a graph for explaining situation where consumption of lubricant largely changes with time because of eating of a brush roller into the lubricant.

As shown in FIG. 10, if a lubricant 82' has corner portions so that a brush roller 83' eats into the lubricant 82', consumption of the lubricant largely increases as shown in a shaded area of FIG. 11 compared to when the brush roller 83 is slidably in contact with the surface of the lubricant 82 (see FIG. 3B). Therefore, if the degree to which the brush roller 83 eats in the lubricant decreases as the corner portions of the lubricant are rounded, the amount of lubricant to be applied largely decreases as shown in FIG. 11.

As described above, if the lubricant has corner portions or bumps, the brush roller eats in those corner portions or bumps, it is difficult to stably apply the lubricant. If the brush roller eats in the lubricant, rotational torque of the brush roller increases. Furthermore, if the brush roller is eating into the lubricant, tip portions of the brush roller may be laid down.

Therefore, it is necessary to avoid a situation where the brush roller eats into corner portions or bumps of the lubricant. Such a situation occurs when the lubricant 82' inclines in a counterclockwise direction as shown in FIG. 10 due to rotation of the brush roller 83 in the direction represented by C1 as shown in FIG. 3B and sliding to the lubricant 82.

Such inclination cannot be avoided in the lubricant applying device 81 due to its structure. The lubricant applying device 81 is configured to have backlash so that the supporting member 85 is freely displaced toward the direction represented by D1. The backlash occurs because outer width of the supporting member 85 in the direction E1, i.e., the length between the outer surfaces of the side portions 85*b*, is set shorter than inner width of the guide member 86 in the direction E1, i.e., the length between the inner surfaces of the side portions 86*b*. Due to such backlash, the lubricant 82 pressed against the brush roller 83 inclines with the supporting member 85 in a counterclockwise direction toward the guide member 86 upon rotating the brush roller 83.

If the lubricant 82 is a quadrangular prism as the lubricant 82' shown in FIG. 10, the brush roller 83 eats into a corner portion of the lubricant 82 due to inclination. To solve such a state, it is preferable to offset a position of the lubricant 82' toward the upstream side in the direction C1'. However, if the amount of offset is excessively large, the brush roller fails to come into contact with some portions of the lubricant, so that use efficiency of the lubricant decreases, resulting in increasing loss of the lubricant. As a result, economic efficiency decreases, and lifetimes of the lubricant and the image forming apparatus is shortened. Thus, there are problems in use efficiency of the lubricant when the position of the lubricant is offset.

Figure 4:
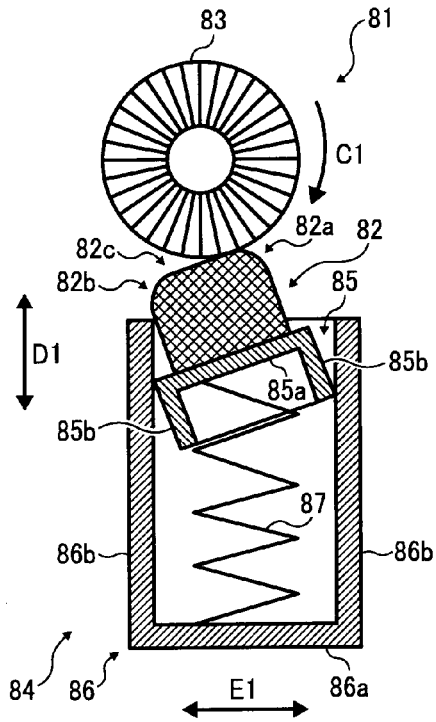
FIG. 4 is a cross sectional view of lubricant set in the lubricant applying device shown in FIG. 3A.

According to the embodiment, as shown in FIG. 4, corner portions 82*a*, 82*b* on the upstream/downstream side in the direction C1 are formed into curved surfaces, i.e., convex facet, toward the brush roller 83. The curved surfaces are symmetrical to the direction represented by D1 as shown in FIG. 3B. A center portion 82 between the corner portions 82*a* and 82*b* along the direction E1 corresponding to the direction C1 is plane.

The lubricant 82 can be formed into the above shape by solidifying the lubricant 82 by using a mold having such a shape, or by removing the corner portions after molding in a quadratic prism. As will be described later, the lubricant 82 can be formed into other shapes in the same manner.

The lubricant can have a curved top portion according to the embodiment. In other words, such a shape can be employed with which a lubricant applying member, such as a brush roller, eats in the lubricant, so that consumption of the lubricant largely changes as the time elapses. Specifically, if consumption at the time of beginning of use of the lubricant is twice as much as, or preferably half as much again as, consumption after the lubricant is used as shown in FIG. 11, it can be considered that the consumption has largely changed.

The corner portions 82*a*, 82*b* have convex surfaces toward the brush roller 83 to stabilize consumption of the lubricant 82. Therefore, the corner portions 82*a*, 82*b* are formed into shapes with which the consumption of the lubricant 82 does not largely change, i.e., the consumption at the time of beginning of use of the lubricant is smaller than twice as much as, or preferably smaller than half as much again as, consumption after the lubricant is used as shown in FIG. 11.

Although the corner portions 82*a*, 82*b* are formed into curved surfaces according to the embodiment, it is sufficient that at least the corner portion 82*a*, which is on an upstream side in the direction C1 along the direction E1, i.e., on a position closest to the brush roller 83 in the direction C1, is formed into such a curved surface to stabilize consumption of the lubricant 82 even when the brush roller 83 eats in the lubricant 82.

However, if both the corner portions 82*a*, 82*b*, are formed into curved surfaces, then at least one of the corner portions 82*a*, 82*b* will come into contact with the brush roller 83 irrespective of in which orientation the lubricant 82 is set to the lubricant applying device 81. Therefore, the lubricant 82 can be easily set to the lubricant applying device 81. Furthermore, the lubricant 82 can be more easily set if the corner portions 82*a*, 82*b* are symmetric.

On the other hand, if the corner portions 82*a*, 82*b* are not symmetric, the lubricant 82 is set to various lubricant applying devices in such a manner that a corner portion having a curved surface suitable for size and configuration of the holding member 84 and the brush roller 83 serves as the corner portion 82*a*.

Although it is assumed that the curved surface is a circular arc according to the embodiment, other shapes such as a parabolic shape or a part of an elliptical shape are applicable if the consumption of the lubricant 82 can be stabilized.

Figure 5:
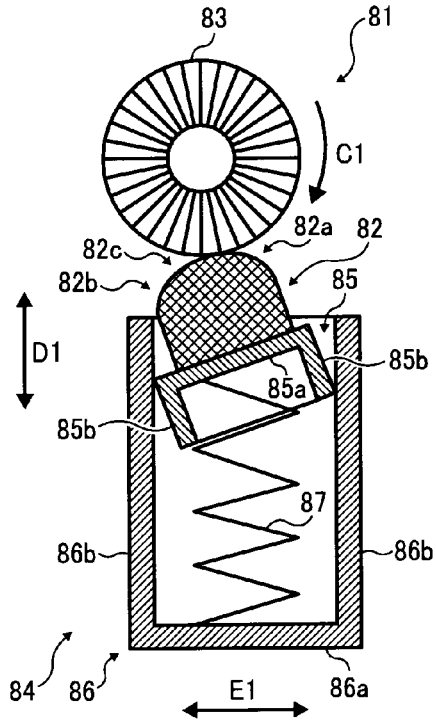
FIG. 5 is a cross sectional view of modification of the lubricant shown in FIG. 4.

As shown in FIG. 5, it is preferable to form the center portion 82C between the corner portions 82*a* and 82*b* on the surface of the lubricant 82 to be in a convex, i.e., a curved surface, toward the brush roller 83C.

The curved surface of a center portion 82*c* is smoothly continued from/to the corner portions 82*a*, 82*b*. When the center portion 82*c* is in a planar shape, or when the center portion 82*c* is not smoothly continued from/to the corner portions 82*a*, 82*b* even when the center portion 82*c* has a curved surface, the consumption of the lubricant may not be stabilized if a portion between the center portion 82*c* and one of the corner portions 82*a*, 82*b* is in contact with the brush roller 83. This is because the amount of the inclination of the lubricant 82 varies due to error in size, erroneous setting of the supporting member 85 and the guide member 86, or change in size over time.

When the center portion 82*c* is smoothly continued from/to the corner portions 82*a*, 82*b*, the lubricant 82 is in contact with the brush roller 83 at the curved surface even if the inclination of the lubricant 82 varies. Therefore, the consumption of the lubricant 82 can be stabilized.

Although it is assumed that the curved surface of the center portion 82*c* is a circular arc, other shapes such as a parabolic shape or a part of an elliptical shape are allowable as far as the consumption of the lubricant 82 can be stabilized.

Furthermore, as long as the curved surface of the center portion 82*c* is smoothly continued to/from the corner portions 82*a*, 82*b*, curvature of each of the center portion 82*c*, and the corner portions 82*a*, 82*b* can be different from one another. As described in connection with FIG. 4, it is sufficient that at least the corner portion 82*a* has a curved surface.

Figure 6:
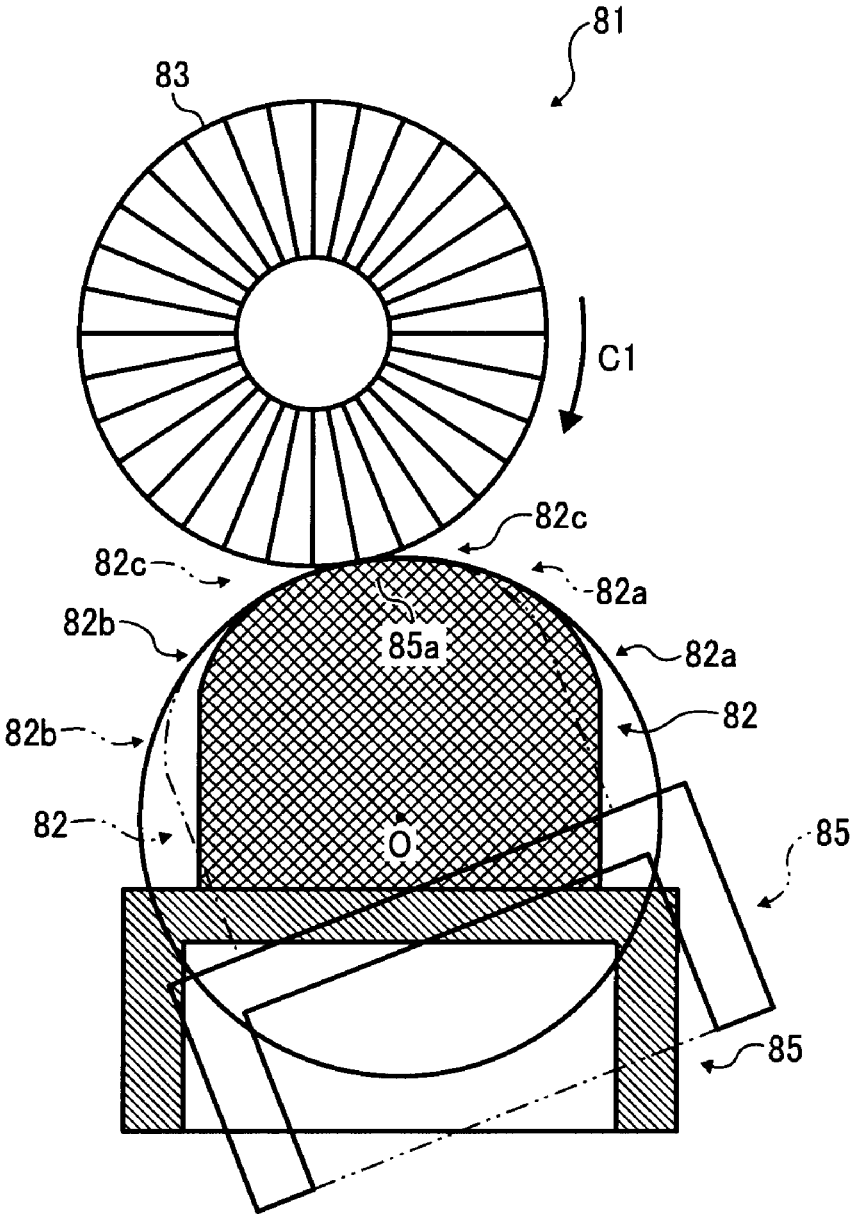
FIG. 6 is a schematic diagram for explaining shape and size of the lubricant shown in FIG. 4 in relation to a state where the lubricant is inclined, and in relation to a size of an applying unit.

As shown in FIG. 6, when the center portion 82*c* has such a curved surface, it is preferable to configure a surface position of at least the center portion 82*c* among the center portion 82*c*, and the corner portions 82*a*, 82*b* is on a line of the surface position or on an extended line of the surface position even if the lubricant 82 inclines.

Accordingly, the holding member 84 holds the lubricant 82 in such a manner that the lubricant 82 rotates around a center of curvature 0 of the center portion 82*c* by adjusting size of the supporting member 85 and the guide member 86, and by using a position adjusting unit (not shown) as appropriate. The position adjusting unit will be described later.

With the above configuration, when the curved surface of the center portion 82*c* is in a circular arc, same curvature of a portion of the center portion 82*c*, which is in contact with the brush roller 83, is maintained even when the lubricant 82 inclines. Therefore, it is possible to stabilize the consumption of the lubricant 82.

The corner portions 82*a*, 82*b* do not necessarily have curved surfaces. However, when the corner portions 82*a*, 82*b* are continued to/from the center portion 82*c*, it is preferable to configure the corner portion 82*b* to have circular arcs with the same curvature. This is because a range of inclination of the lubricant 82 to be held on the surface position of the center portion 82*c* or the corner portion 82*a* can be widened.

Furthermore, as shown in FIG. 6, when the center portion 82*c* has a curved surface, it is preferable that the curvature radius of the center portion 82*c* is larger than that of the brush roller 83. If the curvature radius of the center portion 82*c* is larger than that of the brush roller 83, the consumption of the lubricant 82 can be more stabilized. Moreover, as the curvature radius of the center portion 82*c* increases, a contact area between the brush roller 83 and the center portion 82*c* increases, resulting in increasing the consumption of the lubricant, i.e., amount of spread of the lubricant increases with the same pressure applied by the spring 87.

As described above, the guide member 86 is extended in the main scanning direction, and has a cross section in an open bracket shape when viewed from a plane orthogonal to the main scanning direction. However, it is sufficient that as long as the guide member 86 guides the lubricant 82 or the supporting member 85 by using a center portion of the lubricant 82 in the main scanning direction and at least two portions symmetrically arranged to the center portion.

The guide member 86 is configured in consideration that the lubricant 82 comes into contact with the side portion 86*b* and comes out of the side portion 86*b* when the lubricant 82 inclines. When the guide member 86 does not have above configuration, and if the lubricant comes into contact with the side portion 86*b*, the lubricant 82 inclines in the main scanning direction due to asymmetric force applied from the side portion 86*b* to the center in the main scanning direction. Accordingly, a portion of the lubricant 82 that protrudes from the side portion 86*b* is asymmetric to the center, so that amount of the lubricant 82 applied onto the transfer belt 11 in the main scanning direction becomes nonuniform.

However, if the guide member 86 is configured in the above manner, even when the lubricant 82 comes into contact with the side portion 86*b* and a portion of the lubricant 82 protrudes from the side portion 86*b*, such a protruding portion is symmetric to the center in the main scanning direction. As a result, the amount of the lubricant 82 to be applied can be uniform.

Thus, the cleaning performance can be uniformly stabilized in the main scanning direction, and the consumption of the lubricant 82 in the main scanning direction can be uniform, resulting in stabilizing the consumption of the lubricant 82.

The side portion 86*b* can support the lubricant 82 or the supporting member 85 at three portions, i.e., the center portion in the main scanning direction and two other portions symmetric to the center portion, if the side portion 86*b* is symmetric in the main scanning direction. Furthermore, it is possible to configure the side portion 86*b* to support the lubricant 82 or the supporting member 85 at portions more than three, or whole contact portions in the main scanning direction as described in the embodiment.

When the side portion 86*b* is arranged in a discontinuous manner in the main scanning direction, each discontinuous part of the side portion 86*b* can be separately arranged, or a side facing the brush roller 83 is arranged in a pectinate line. The discontinuous arrangement is preferable in that weight of the side portion 86*b* can be reduced.

The lubricant 82 is likely to come into contact with the side portion 86*b* at downstream side in the direction C1 due to inclination. Therefore, it is possible to form at least the side portion 86*b* on a downstream side in the direction C1 is formed in the above manner.

A toner that can be used in the image forming apparatus 100 is described below.

For realizing fine dots with 600 dpi (dots per inch) or more, it is preferable to set volume-average particle size of the toner in a range between 3 micrometers and 8 micrometers. The ratio between the volume-average particle size (Dv) and number average particle size (Dn), i.e., Dv/Dn, is preferably in a range between 1.0 and 1.4.

When Dv/Dn comes close to 1.0, particle size distribution becomes sharp. With such a toner having small particle size and tight particle size distribution, distribution of amount of charge becomes uniform, resulting in generating an image in a high quality with less background defect. Furthermore, it is possible to increase transferability in an electrostatic transfer type image forming apparatus.

Figure 7:
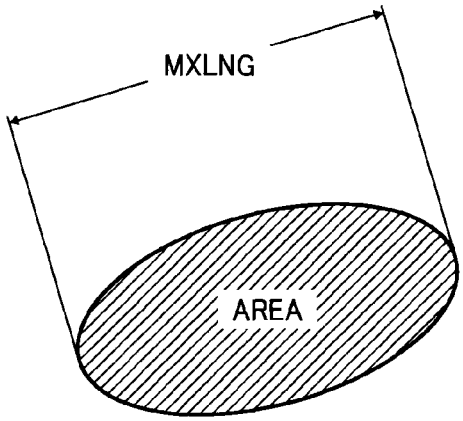
FIG. 7 is a schematic diagram for explaining shape factor SF-1 of toner that can be used in the image forming apparatus shown in FIG. 1.
Figure 8:
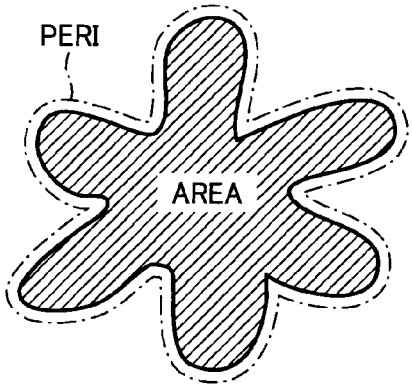
FIG. 8 is a schematic diagram for explaining shape factor SF-2 of toner that can be used in the image forming apparatus shown in FIG. 1.

It is preferable to set shape factor SF-1 of toner in a range between 100 to 180, while a shape factor SF-2 in a range between 100 and 180. FIGS. 7 and 8 are schematic diagrams for explaining the shape factors SF-1 and SF-2 of the toner to be used in the image forming apparatus 100.

The shape factor SF-1 indicates roundness of the toner, as defined by Equation (1). In other words, the shape factor SF-1 is a value obtained by dividing square of maximum length (MXLNG) of a shape of toner projected on a two-dimensional plane by an area (AREA) of the shape, and then by multiplying 100π/4.

$$SF\text{-}1=\{(\mathrm{MXLNG})^2/\mathrm{AREA}\}\times(100\pi/4) \quad (1)$$

When SF-1 equals to 100, the toner is a perfect sphere, and as SF-1 increases, the shape of the toner becomes more infinite.

The shape factor SF-2 indicates irregularity of the toner, as defined by Equation (2). In other words, the shape factor SF-2 is a value obtained by dividing square of perimeter (PER1) of a shape of toner projected on a two-dimensional plane by an area (AREA) of the shape, and then by multiplying 100π/4.

$$SF\text{-}2=\{(\mathrm{PER1})^2/\mathrm{AREA}\}\times(100\pi/4) \quad (2)$$

When SF-2 equals to 100, irregularity is not present on the surface of the toner, and as SF-2 increases, the irregularity of the surface of the toner increases.

The shape factors are measured by taking photographs of toner by using a scanning electron microscope (S-800, Hitachi, Ltd.), and by analyzing and calculating taken photographs by using an image analyzer (LUSEX3, Nireko, Ltd.).

As the shape of the toner becomes closer to sphere, toners make point contacts with each other, or toner and photosensitive drum make point contact with each other, so that absorbability between the toners decreases, increasing flowability of the toner. Furthermore, the absorbability between the toner and the photosensitive drum decreases, resulting in increasing transferability. When one of SF-1 and SF-2 exceeds 180, transferability decreases, which is not preferable.

The toner is obtained by performing cross linked and/or elongation reaction between toner material solution, in which at least polyester prepolymer containing functional group including nitride atom, colorant, mold lubricant is distributed in organic solvent, and water-based solvent.

Polyester is obtained by a polycondensation reaction of a polyhydric alcohol compound and a polycarboxylic compound.

Dihydric alcohols (DIO) and trihydric or higher polyhydric alcohols (TO) are examples of the polyhydric alcohol compounds (PO). (DIO) by itself or a mixture of (DIO) and a small amount of (TO) is desirable as (PIO). Alkylene glycols (ethylene glycol, 1,2-propylene glycol, 1,3-propylene glycol, 1,4-butane diol, 1,6-hexane diol etc.), alkylene ether glycols (diethylene glycol, triethylene glycol, dipropylene glycol, polyethylene glycol, polypropylene glycol, polytetramethylene ether glycol etc.), alicyclic diols (1,4-cyclohexane dimethanol, hydrogenated bisphenol A etc.), bisphenols (bisphenol A, bisphenol F, bisphenol S etc.), alkylene oxide adducts (ethylene oxide, propylene oxide, butylene oxide etc.) of the alicyclic diols mentioned earlier, and alkylene oxide adducts (ethylene oxide, propylene oxide, butylene oxide etc.) of the bisphenols mentioned earlier are examples of dihydric alcohols (DIO). Alkylene glycols of carbon number 2 to 12 and alkylene oxide adducts of bisphenols are desirable as dihydric alcohols. Alkylene oxide adducts of bisphenols and a combination of alkylene oxide adducts of bisphenols and alkylene glycols of carbon number 2 to 12 are especially desirable as dihydric alcohols. Examples of trihydric or higher polyhydric alcohols (TO) are trihydric to octahydric alcohols or higher polyaliphatic alcohols (glycerin, trimethylol ethane, trimethylol propane, pentaerythritol, sorbitol etc.), triphenols or higher polyphenols (such as trisphenol PA, phenol novolac, cresol novolac etc.), and alkylene oxide adducts of the triphenols or higher polyphenols mentioned earlier.

Examples of the polycarboxylic acids (PC) are dicarboxylic acid (DIC) and tricarboxylic or higher polycarboxylic acids (TC). (DIC) by itself or a mixture of (DIC) and a small amount of (TC) is desirable as (PC). Examples of the dicarboxylic acids (DIC) are alkylene dicarboxylic acids (succinic acid, adipic acid, sebacic acid etc.), alkenylene dicarboxylic acids (maleic acid, fumaric acid etc.), aromatic carboxylic acids (phthalic acid, isophthalic acid, terephthalic acid, naphthalene dicarbonic acid etc.). Alkenylene dicarboxylic acids of carbon number 4 to 20 and aromatic dicarboxylic acids of carbon number 8 to 20 are desirable as dicarboxylic acids (DIC). Examples of tricarboxylic or higher polycarboxylic acids (TC) are aromatic polycarboxylic acids of carbon number 9 to 20 (trimellitic acid, pyromellitic acid etc.). Further, causing acid anhydrides of the compounds mentioned earlier, or lower alkyl esters (methyl ester, ethyl ester, isopropyl ester etc.) to react with the polyhydric alcohols (PO) also enables to obtain the polycarboxylic acids (PC).

A ratio of the polyhydric alcohols (PO) and the polycarboxylic acids (PC), which is expressed as an equivalent ratio (OH)/(COOH) of a hydroxyl group (OH) and a carboxyl group (COOH) is normally 2/1 to 1/1. A ratio of 1.5/1 to 1/1 is desirable, and a ratio of 1.3/1 to 1.02/1 is further desirable.

In the polycondensation reaction of the polyhydric alcohols (PO) and the polycarboxylic acids (PC), the polyhydric alcohols (PO) and the polycarboxylic acids (PC) are heated to 150° to 280° C. in the presence of a commonly known esterification catalyst such as tetra butoxy titanate, dibutyltin oxide etc. Pressure is reduced if required and water generated during the reaction is distilled to obtain polyester that includes a hydroxyl group. A hydroxyl group number of greater than or equal to 5 is desirable for the polyester. An acid number of the polyester is normally 1 to 30, and an acid number of 5 to 20 is desirable. Causing the polyester to include the acid number increases the negative electrostatic charge of the toner. Further, when fixing the toner on a recording sheet, the acid number enhances affinity of the recording sheet and the toner and also enhances low temperature fixability. However, if the acid number exceeds 30, a stability of the electrostatic charge is adversely affected, especially with respect to environmental variations.

A weight average molecular weight of the polyester is 10000 to 400,000 and a weight average molecular weight of 20000 to 200,000 is desirable. A weight average molecular weight of less than 10000 causes anti-offset ability of the toner to deteriorate and is not desirable. Further, the weight average molecular weight exceeding 400,000 causes the low temperature fixability of the toner to deteriorate and is not desirable.

Apart from the unmodified polyester, which is obtained by the polycondensation reaction mentioned earlier, a urea modified polyester is also desirable and included. For obtaining the urea modified polyester, a carboxyl group or a hydroxyl group at the end of the polyester, which is obtained by the polycondensation reaction, is caused to react with a polyisocyanate compound (PIC) to get polyester prepolymer (A) that includes an isocyanate group. The polyester prepolymer (A) is caused to react with amines and during the reaction, a molecular chain is subjected to any one of the crosslinking reaction or the elongation reaction or both to obtain the urea modified polyester.

Examples of polyisocyanate compounds (PIC) are aliphatic polyisocyanates (tetramethylene diisocyanate, hexamethylene diisocyanate, 2,6-diisocyanatomethyl caproate etc.), alicyclic polyisocyanates (isophorone diisocyanate, cyclohexyl methane diisocyanate etc.), aromatic diisocyanates (tolylene diisocyanate, diphenyl methane diisocyanate etc.), aromatic aliphatic diisocyanates (α,α,α',α'-tetramethyl xylylene diisocyanate etc.), isocyanates, compounds that are obtained by blocking the polyisocyanates mentioned earlier using phenol derivatives, oximes, caprolactum etc., and combinations of two or more types of the compounds mentioned earlier.

A ratio of the polyisocyanate compounds (PIC) which is expressed as an equivalent ratio (NCO)/(OH) of an isocyanate group (NCO) and a hydroxyl group (OH) of the polyester that includes a hydroxyl group, is normally 5/1 to 1/1. A ratio of 4/1 to 1.2/1 is desirable, and a ratio of 2.5/1 to 1.5/1 is further desirable. If the ratio of (NCO)/(OH) exceeds 5, the low temperature fixability of the toner deteriorates. If a mole ratio of (NCO) is less than one, when using the urea modified polyester, a urea content in the polyester decreases and the anti-offset ability of the toner deteriorates.

An amount of the polyisocyanate compound (PIC) component in the polyester prepolymer (A) that includes an isocyanate group is normally 0.5 to 40 percent by weight. An amount of 1 to 30 percent by weight is desirable, and an amount of 2 to 20 percent by weight is further desirable. If the amount of the polyisocyanate compound (PIC) component is less than 0.5 percent by weight, the anti-offset ability of the toner deteriorates and maintaining a balance between heat resistant storability and the low temperature fixability of the toner becomes difficult. Further, if the amount of the polyisocyanate compound (PIC) component exceeds 40 percent by weight, the low temperature fixability of the toner deteriorates.

A number of isocyanate groups included in the polyester prepolymer (A) per molecule is normally greater than or equal to one. An average of 1.5 to 3 isocyanate groups per molecule are desirable and an average of 1.8 to 2.5 isocyanate groups per molecule are further desirable. If the number of isocyanate groups per molecule is less than one, a molecular weight of the urea modified polyester decreases and the anti-offset ability of the toner deteriorates.

Examples of amines (B) which are caused to react with the polyester prepolymer (A) are diamine compounds (B1), triamines or higher polyamine compounds (B2), amino alcohols (B3), amino mercaptans (B4), amino acids (B5), and compounds (B6) in which amino groups of B1 to B5 are blocked.

Examples of the diamine compounds (B1) are aromatic diamines (phenylene diamine, diethyl toluene diamine, 4,4'-diamineodiphenyl methane etc.), alicyclic diamines (4,4'-diamino-3,3'-dimethyl dicyclohexyl methane, diamine cyclohexane, isophorone diamine etc.), and aliphatic diamines (ethylene diamine, tetramethylene diamine, hexamethylene diamine etc.). Examples of the triamines or higher polyamine compounds (B2) are diethylene triamine and triethylene tetramine. Examples of the amino alcohols (B3) are ethanolamine and hydroxyethyl aniline. Examples of the amino mercaptans (B4) are aminoethyl mercaptan and aminopropyl mercaptan. Examples of the amino acids (B5) are aminopropionic acid and aminocaproic acid. Ketimine compounds and oxazolidine compounds, which are obtained from the amines B1 to B5 mentioned earlier and ketones (acetone, methyl ethyl ketone, methyl isobutyl ketone etc.), are examples of the compounds (B6) wherein the amino groups of B1 to B5 are blocked. Among the amines (B), the diamine compounds of B1 and the compounds that include B1 and a small amount of B2 are desirable.

A ratio of the amines (B), which is expressed as an equivalent ratio (NCO)/(NHx) of an isocyanate group (NCO) from the polyester prepolymer (A) that includes the isocyanate group and an amino group (NHx) from the amines (B), is normally 1/2 to 2/1. A ratio of 1.5/1 to 1/1.5 is desirable, and a ratio of 1.2/1 to 1/1.2 is further desirable. If the ratio (NCO)/(NHx) becomes greater than 2 or less than 1/2, the molecular weight of the urea modified polyester is reduced and the anti-offset ability of the toner deteriorates.

The urea modified polyester can also include urethane linkages along with urea linkages. A mole ratio of an amount of the urea linkages and an amount of the urethane linkages is normally 100/0 to 10/90. A mole ratio of 80/20 to 20/80 is desirable and a mole ratio of 60/40 to 30/70 is further desirable. If the mole ratio of the urea linkages is less than 10 percent, the anti-offset ability of the toner deteriorates.

The urea modified polyester is manufactured using a one shot method etc. The polyhydric alcohols (PO) and the polycarboxylic acids (PC) are heated to 150° to 280° C. in the presence of a commonly known esterification catalyst such as tetra butoxy titanate, dibutyltin oxide etc. Pressure is reduced if required and water generated during the reaction is distilled to obtain the polyester that includes the hydroxyl group. Next, the polyester is caused to react with polyisocyanate (PIC) at 40° to 140° C. to get the polyester prepolymer (A) that includes an isocyanate group. Next, the polyester prepolymer (A) is caused to react with the amines (B) at 0° to 140° C. to get the urea modified polyester.

When causing the polyester to react with (PIC) and when causing (A) to react with (B), a solvent can also be used if required. Examples of the solvents that can be used are aromatic solvents (toluene, xylene etc.), ketones (acetone, methyl isobutyl ketone etc.), esters (ethyl acetate etc.), amides (dimethyl formamide, dimethyl acetoamide etc.), and ethers (tetrahydrofuran etc.) that are inactive with respect to the isocyanates (PIC).

Further, during any one of the crosslinking reaction or the elongation reaction or both between the polyester prepolymer (A) and the amines (B), a reaction terminator can also be used if required and the molecular weight of the obtained urea modified polyester can be regulated. Examples of the reaction terminator are monoamines (diethylamine, dibutylamine, butylamine, laurylamine etc.) and compounds (ketimine compounds) in which the monoamines are blocked.

The weight average molecular weight of the urea modified polyester is normally greater than or equal to 10,000. A weight average molecular weight of 20,000 to 100,000,000 is desirable and a weight average molecular weight of 30,000 to 1,000,000 is further desirable. If the weight average molecular weight of the urea modified polyester is less than 10,000, the anti-offset ability of the toner deteriorates. When using the unmodified polyester, a number average molecular weight of the urea modified polyester is not especially limited, and any number average molecular weight that is easily converted into the weight average molecular weight can be used. When using the urea modified polyester by itself, the number average molecular weight of the urea modified polyester is normally 2,000 to 15,000. A number average molecular weight of 2,000 to 10,000 is desirable and a number average molecular weight of 2,000 to 8,000 is further desirable. The number average molecular weight of the urea modified polyester exceeding 20,000 results in deterioration of the low temperature fixability and the gloss of the toner when the toner is used in a full color device.

Using a combination of the unmodified polyester and the urea modified polyester enables to enhance the low temperature fixability of the toner and the gloss when the toner is used in a full color image forming apparatus 100. Thus, using a combination of the unmodified polyester and the urea modified polyester is desirable than using the urea modified polyester by itself. Further, the unmodified polyester can also include polyester that is modified using chemical linkages other than the urea linkages.

At least a portion of the unmodified polyester and the urea modified polyester being mutually compatible is desirable for the low temperature fixability and the anti-offset ability. Thus, a similar composition of the unmodified polyester and the urea modified polyester is desirable.

A weight ratio of the unmodified polyester and the urea modified polyester is normally 20/80 to 95/5. A weight ratio of 70/30 to 95/5 is desirable, a weight ratio of 75/25 to 95/5 is further desirable, and a weight ratio of 80/20 to 93/7 is especially desirable. If the weight ratio of the urea modified polyester is less than 5 percent, the anti-offset ability of the toner deteriorates and maintaining a balance between heat resistant storability and the low temperature fixability of the toner becomes difficult.

A glass transition point ($T_g$) of a binder resin that includes the unmodified polyester and the urea modified polyester is normally 45° C. to 65° C. A glass transition point of 45° C. to 60° C. is desirable. If the glass transition point is less than 45° C., a heat resistance of the toner deteriorates. If the glass transition point exceeds 65° C., the low temperature fixability of the toner becomes insufficient.

Because the urea modified polyester is likely to remain on the surface of the obtained parent toner particles, regardless of the low glass transition point, heat resistant storability of the toner is favorable compared to a commonly known polyester type toner.

All commonly known dyes and pigments can be used as colorants. Examples of the colorants that can be used are carbon black, nigrosine dye, iron black, naphthol yellow S, hansa yellow (10G, 5G, G), cadmium yellow, yellow iron oxide, yellow ocher, chrome yellow, titanium yellow, polyazo yellow, oil yellow, hansa yellow (GR, A, RN, R), pigment yellow L, benzidine yellow (G, GR), permanent yellow (NCG), vulcan fast yellow (5G, R), tartrazine lake, quinoline yellow lake, anthrazane yellow BGL, isoindolinone yellow, red iron oxide, minium, red lead, cadmium red, cadmium mercury red, antimony vermilion, permanent red 4R, para red, fire red, parachloro-ortho-nitroaniline red, lithol fast scarlet G, brilliant fast scarlet, brilliant carmine BS, permanent red (F2R, F4R, FRL, FRLL, F4RH), fast scarlet VD, vulcan fast rubin B, brilliant scarlet G, lithol rubin GX, permanent red F5R, brilliant carmine 6B, pigment scarlet 3B, Bordeaux 5B, toluidine maroon, permanent bordeaux F2K, helio Bordeaux BL, Bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue alkali blue lake, peacock blue lake, Victoria blue lake, metal-free phthalocyanine blue, phthalocyanine blue, fast sky blue, indanthrene blue (RS, BC), indigo, ultramarine blue, Prussian blue, anthraquinone blue, fast violet B, methyl violate lake, cobalt purple, Manganese purple, dioxane violate, anthraquinone violet, chrome green, zinc green, chrome oxide, pyridian, emerald green, pigment green B, naphthol green B, green gold, acid green lake, malachite green lake, phthalocyanine green, anthraquinone green, titanium oxide, zinc white, lithopone and mixtures of the colors mentioned earlier. A colorant content is normally 1 to 15 percent by weight with respect to the toner, and a colorant content of 3 to 10 percent by weight is desirable.

The colorant can also be used as a master batch that is combined with the resin. Styrenes such as polystyrene, poly-p-chlorostyrene, polyvinyl toluene, substitute polymers of the styrenes mentioned earlier, copolymers of the styrenes mentioned earlier with vinyl compounds, polymethyl methacrylate, polybutyl methacrylate, polyvinyl chloride, polyvinyl acetater, polyethylene, polypropylene, polyester, epoxy resin, epoxypolyol resin, polyurethane, polyamide, polyvinyl butylal, polyacrylic acid resin, rodine, modified rodine, terpene resin, aliphatic or alicyclic hydrocarbon resin, aromatic petroleum resin, chlorinated paraffin, paraffin wax etc. are examples of the binder resins that are used in the manufacture of the master batch or that are mixed with the master batch. The binder resins mentioned earlier can be used independently or as a mixture.

Commonly known electric charge controllers can be used. Examples of the electric charge controllers are nigrosine dyes, triphenyl methane dyes, chromium-containing metal complex dyes, chelate molybdate pigment, rhodamine dyes, alkoxy amine, quaternary ammonium salt (includes fluorine modified quaternary ammonium salt), alkyl amide, phosphorus in element or compound form, tungsten in element or compound form, fluorine series activator, salicylic acid metal salt and metal salt of salicylic acid derivative. Specific examples of the electric charge controllers are bontron 03 that is a nigrosine series dye, bontron P-51 that is a quaternary ammonium salt, bontron S-34 that is a metal-containing azo dye, E-82 that is an oxynaphthoe acid metal complex, E-84 that is a salicylic acid metal complex, E-89 that is a phenol condensate (the chemicals mentioned earlier are manufactured by Orient Chemical Industries), TP-302 that is a quaternary ammonium salt molybdenum complex, TP-415 (the chemicals mentioned earlier are manufactured by Hodogaya Chemicals Company), copy charge PSY VP2038 that is a quaternary ammonium salt, copy blue PR that is a triphenyl methane derivative, copy charge NEG VP2036 that is a quaternary ammonium salt, copy charge NX VP434 (the chemicals mentioned earlier are manufactured by Hochst Company), LRA-901, LR-147 that is a boron complex (manufactured by Japan Carlit Company), copper phthalocyanine, perylene, quinacridone, azo type pigment, and other polymeric compounds that include functional groups such as sulfonic acid group, carboxyl group, quaternary ammonium salt etc. Among the materials mentioned earlier, the materials that especially control the toner to the negative polarity are desirably used. A usage amount of the electric charge controller is decided according to a toner manufacturing method that includes a type of the binder resin, presence of the additive agent that is used if necessary, a dispersion method etc. Thus, the usage amount of the electric charge controller is not uniquely limited. However, the usage amount in a range of 0.1 to 10 parts by weight of the electric charge controller with respect to 100 parts by weight of the binder resin is desirably used. A range of 0.2 to 5 parts by weight of the electric charge controller is desirable. If the usage amount of the electric charge controller exceeds 10 parts by weight, the excess electrostatic charge of the toner reduces the effect of the electric charge controller and increases the electrostatic attraction between the toner and the developing roller. Due to this, fluidity of the developer and image density are reduced.

When dispersed with the binder resin, wax which includes a low melting point of 50° C. to 120° C. functions effectively as the mold releasing agent between a fixing roller and a toner surface. Due to this, wax is effective against heat offset and removes a necessity to coat the fixing roller with the mold releasing agent. Examples of materials, which are used as a wax component, are described below. Examples of wax materials are plant wax such as carnauba wax, cotton wax, wood wax, rice wax etc., animal wax such as beeswax, lanolin etc., mineral wax such as ozokerite, cercine etc., and petroleum wax such as paraffin, microcrystalline, petrolatum etc. Further, apart from natural wax mentioned earlier, synthetic hydrocarbon wax such as Fischer-Tropsch wax, polyethylene wax, and synthetic wax such as ester, ketone, and ether can also be used. Further, fatty amides such as 1,2-hydroxystearic acid amide, stearic acid amide, phthalic anhydride imide, chlorinated hydrocarbon, and crystalline polymer molecules that include a long alkyl group in a side chain, in other words, polyacrylate homopolymers or copolymers (for example, copolymers of n-stearyl acrylate-ethyl methacrylate etc.) such as poly-n-stearyl methacrylate, poly-n-lauryl methacrylate can also be used.

The electric charge controller and the mold releasing agent can also be melted and mixed with the master batch and the binder resin. Further, the electric charge controller and the mold releasing agent can also be added when the master batch and the binder resin are dissolved and dispersed in the organic solvent.

Inorganic particles are desirably used as the external additive agent for supplementing fluidity, developability, and electrostatic charge of the toner. A primary particle diameter of $5\times10^{-3}$ μm to 2 μm is desirable for the inorganic particles and a primary particle diameter of $5\times10^{-3}$ to 0.5 (μm) is further desirable. Further, a specific surface area of 20 to 500 ($m^2/g$) according to Brunauer Emmet Teller (BET) method is desirable for the inorganic particles. A usage percentage of 0.01 to 5 percent by weight of the toner is desirable for the inorganic particles and a usage percentage of 0.01 to 2.0 percent by weight is especially desirable.

Specific examples of the inorganic particles are silica, alumina, titanium oxide, barium titanate, magnesium titanate, calcium titanate, strontium titanate, zinc oxide, tin oxide, silica sand, clay, mica, silica apatite, diatomite, chromium oxide, serium oxide, colcothar, antimony trioxide, magnesium oxide, zirconium oxide, barium sulphate, barium carbonate, calcium carbonate, silicon carbide, silicon nitride etc. Especially, using a combination of hydrophobic silica particles and hydrophobic titanium oxide particles as a fluidity enhancer is desirable. Especially, if hydrophobic silica particles and hydrophobic titanium oxide particles having an average particle diameter of less than or equal to $5\times10^{-2}$ (μm) are mixed by stirring, electrostatic power and van der Waals power of the toner are significantly enhanced. Due to this, the fluidity enhancer is not detached from the toner even if the fluidity enhancer is mixed by stirring inside a developing device for getting a desired electrostatic charge level. Thus, a better image quality can be obtained by preventing occurrence of dots and the transfer residual toner can be reduced.

Although using the titanium oxide particles is desirable for better environmental stability and image density stability, because a charge rising property of the toner increasingly deteriorates, if an additive amount of the titanium oxide particles becomes more than an additive amount of the silica particles, influence of the side effect mentioned earlier is likely to increase. However, if the additive amounts of the hydrophobic silica particles and the hydrophobic titanium oxide particles are in a range of 0.3 to 1.5 percent by weight, the charge rising property of the toner is not significantly affected and a desired charge rising property can be obtained. In other words, a stable image quality can be obtained even if the image is repeated copied.

The manufacturing method of the toner is explained next. Although the manufacturing method explained below is desirable, the present invention is not to be thus limited.

First, the coloring agent, the unmodified polyester, the polyester prepolymer that includes an isocyanate group, and the mold releasing agent are dispersed in the organic solvent to form the toner material solution.

A volatile organic solvent having a boiling point of less than 100° C. is desirable for easy removal of the organic solvent after formation of the parent toner particles. To be specific, toluene, xylene, benzene, tetrachlorocarbon, chloromethylene, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone etc. can be used alone or a combination of two or more chemicals mentioned earlier can be used. Especially, aromatic solvents such as toluene, xylene and halogenated hydrocarbons such as chloromethylene, 1,2-dichloroethane, chloroform, tetrachlorocarbon are desirable. A usage amount of the organic solvent is normally 0 to 300 parts by weight of the organic solvent with respect to 100 parts by weight of the polyester prepolymer. A usage amount of 0 to 100 parts by weight of the organic solvent is desirable and a usage amount of 25 to 70 parts by weight of the organic solvent is further desirable.

Next, the toner material solution is emulsified in the aqueous solvent in the presence of a surface active agent and resin particles.

Water alone can be used as the aqueous solvent. Further, aqueous solvents that include organic solvents such as alcohols (methanol, isopropyl alcohol, ethylene glycol etc.), dimethyl formamide, tetrahydrofuran, cellosolves (methyl cellosolve etc.), lower ketones (acetone, methyl ethyl ketone etc.) can also be used.

A usage amount of the aqueous solvent is normally 50 to 2000 parts by weight of the aqueous solvent with respect to 100 parts by weight of the toner material solution. A usage amount of 100 to 1000 parts by weight of the aqueous solvent is desirable. If the usage amount of the aqueous solvent becomes less than 50 parts by weight, the dispersed state of the toner material solution deteriorates and toner particles of a predetermined particle diameter cannot be obtained. If the usage amount of the aqueous solvent exceeds 20000 parts by weight, toner manufacturing is not economical.

A dispersing agent such as the surface active agent or the resin particles is suitably added for enhancing the dispersion in the aqueous solvent. Examples of the surface active agent are anionic surface active agents such as alkylbenzene sulfonate, α-olefine sulfonate, ester phosphate, amine salts such as alkylamine salts, amino alcohol fatty acid derivatives, polyamine fatty acid derivatives, imidazolin, cationic surface active agent of quaternary ammonium salt type such as alkyl trimethyl ammonium salt, dialkyl dimethyl ammonium salt, alkyl dimethyl benzyl ammonium salt, pyridium salt, alkyl isoquinolium salt, chlorobenzetonium, nonionic surface active agent such as fatty acid amide derivatives, polyhydric alcohol derivatives, and zwitterionic surface active agent such as alanine, dodecyldi (aminoethyl) glycine, di(octylaminoethyl) glycine, N-alkyl-N,N-dimethyl ammonium betaine.

Using the surface active agent that includes a fluoroalkyl group enables to enhance the effect of the surface active agent using an extremely small amount of the surface active agent. Examples of desirably used anionic surface active agents that include a fluoroalkyl group are fluoroalkyl carboxylic acids of carbon number 2 to 10 and metal salts of the fluoroalkyl carboxylic acids, perfluorooctane sulfonyl dinatrium gultaminate, 3-(ω-fluoroalkyl (C6 to C11) oxy)-1-alkyl (C3 to C4) natrium sulfonate, 3-(ω-fluoroalkanoyl (C6 to C8)-N-ethylamino)-1-propane natrium sulfonate, fluoroalkyl (C11 to C20) carboxylic acid and metal salts of fluoroalkyl (C11 to C20) carboxylic acid, perfluoroalkyl carboxylic acid (C7 to C13) and metal salts of perfluoroalkyl carboxylic acid (C7 to C13), perfluoroalkyl (C4 to C12) sulfonic acid and metal salts of perfluoroalkyl (C4 to C12) sulfonic acid, perfluorooctane sulfonic acid diethanol amide, N-propyl-N-(2-hydroxyethyl perfluorooctane sulfonic amide, perfluoroalkyl (C6 to C10) sulfonic amide propyl trimethyl ammonium salt, perfluoroalkyl (C6 to C10)-N-ethylsulfonyl glycine salt, monoperfluoroalkyl (C6 to C16) ethyl phosphoric acid ester etc.

Examples of product names are saflon S-111, S-112, S-113 (manufactured by Asahi Glass Company), flolard FC-93, FC-95, FC-98, FC-129 (manufactured by Sumitomo 3M Company), unidine DS-101, DS-102 (manufactured by Daikin Industries Company), megafac F-110, F-120, F-113, F-191, F-812, F-833 (manufactured by Dai Nihon Ink Company), ektop EF-102, 103, 104, 105, 112, 123A, 123B, 306A, 501, 201, 204 (manufactured by Tohkem Products Company), futargent F-100, F-150 (manufactured by Neos Company) etc.

Examples of the cationic surface active agent are aliphatic primary or secondary amino acids that include a fluoroalkyl group, aliphatic quaternary ammonium salts such as perfluoroalkyl (C6 to C10) sulfonic amide propyl trimethyl ammonium salt, benzalkonium salt, benzetonium chloride, pyridium salt, and imidazolium salt. Examples of product names are saflon S-121 (manufactured by Asahi Glass Company), flolard FC-135 (manufactured by Sumitomo 3M Company), unidine DS-202 (manufactured by Daikin Industries Company), megafac F-150, F-824 (manufactured by Dai Nihon Ink Company), ektop EF-132 (manufactured by Tohkem Products Company), and futargent F-300 (manufactured by Neos Company) etc.

The resin particles are added for stabilizing the parent toner particles that are formed in the aqueous solvent. To stabilize the parent toner particles, the resin particles are desirably added such that a surface coverage of the resin particles on the surface of the parent toner particles is in a range of 10 to 90 percent. Examples of the resin particles are methyl polymethacrylate particles of 1 (μm) and 3 (μm), polystyrene particles of 0.5 (μm) and 2 (μm), poly (styrene-acryronitrile) particles of 1 (μm) etc. Examples of product names are PB-200H (manufactured by Kao Company), SGP (manufactured by Soken Company), technopolymer-SB (manufactured by Sekisui Plastics Company), SGP-3G (manufactured by Soken Company), micropearl (manufactured by Sekisui Fine Chemicals Company) etc. Further, inorganic compound dispersing agents such as tricalcium phosphate, calcium carbonate, titanium oxide, colloidal silica, hydroxyapatite etc. can also be used.

Dispersion droplets of the resin particles mentioned earlier can also be stabilized as the dispersing agent that can be used in combination with the inorganic compound dispersing agent by using a polymeric protecting colloid. Examples of the polymeric protecting colloids that can be used are acids such as acrylic acid, methacrylic acid, α-cyanoacrylic acid, α-cyanomethacrylic acid, itaconic acid, crotonic acid, fumaric acid, maleic acid or maleic anhydride, methacrylic monomers that include a hydroxyl group, for example, acrylic acid-β-hydroxyethyl, methacrylic acid-β-hydroxyethyl, acrylic acid-β-hydroxypropyl, methacrylic acid-β-hydroxypropyl, acrylic acid-γ-hydroxypropyl, methacrylic acid-γ-hydroxypropyl, acrylic acid-3-chloro-2-hydroxypropyl, methacrylic acid-3-chloro-2-hydroxypropyl, diethylene glycol monoacrylic acid ester, diethylene glycol monomethacrylic acid ester, glycerin monoacrylic acid ester, glycerin mono methacrylic acid ester, N-methylol acrylic amide, N-methylol methacrylic amide etc., vinyl alcohol or ethers with vinyl alcohol, for example, vinyl methyl ether, vinyl ethyl ether, vinyl propyl ether etc., esters of compounds that include a vinyl alcohol and a carboxyl group, for example, vinyl acetate, vinyl propionate, vinyl butyrate etc., acrylic amide, methacrylic amide, diacetone acrylic amide or methylol compounds of acrylic amide, methacrylic amide, and diacetone acrylic amide, acid chlorides such as chloride acrylate, methacrylic chloride, nitrogen containing compounds, for example, vinyl pyridine, vinyl pyrrolidone, vinyl imidazol, ethyleneimine etc. or heterocyclic homopolymers or copolymers of the nitrogen containing compounds, polyoxyethylenes, for example, polyoxyethylene, polyoxypropylene, polyoxyethylene alkylamine, polyoxypropylene alkyl amine, polyoxyethylene alkyl amide, polyoxypropylene alkyl amide, polyoxyethylene nonylphenyl ether, polyoxyethylene laurylphenyl ether, polyoxyethylene stearylphenyl ester, polyoxyethylene nonylphenyl ester etc., and celluloses, for example, methyl cellulose, hydroxy ethyl cellulose, hydroxy propyl cellulose etc.

The dispersion method is not limited to any specific method, and commonly known methods such as a low speed shearing method, a high speed shearing method, a friction method, a high pressure jet method can be applied. The high speed shearing method is desirable for ensuring a particle diameter of 2 to 20 (μm) for a dispersion element. When using a high speed shearing method dispersing device, although a number of revolutions is not limited to a specific number, the number of revolutions is normally 1000 to 30000 revolutions per minute (rpm), and a number of 5000 to 20000 (rpm) is desirable. Although a dispersion time period is not limited to a specific time period, when using a batch method, the dispersion time period is normally 0.1 to 5 minutes. Normally, the dispersion is carried out at a temperature of 0° to 150° C. (under pressure) and a temperature of 40° to 98° C. is desirable.

Next, along with preparation of an emulsified liquid, the amines (B) are simultaneously added and the emulsified liquid is caused to react with the polyester prepolymer (A) that includes an isocyanate group.

During the reaction mentioned earlier, the molecular chain is subjected to any one of the crosslinking reaction or the elongation reaction or both. Although a reaction time period is selected based on a reactivity of an isocyanate group structure included in the polyester prepolymer (A) with the amines (B), the reaction time period is normally 10 minutes to 40 hours, and a reaction time period of 2 to 24 hours is desirable. A reaction temperature is normally 0° C. to 150° C. and a reaction temperature of 40° C. to 98° C. is desirable. A commonly known catalyst can be used if required. To be specific, a catalyst such as dibutyltin laurate or dioctyltin laurate can be used.

After completion of the reaction, the organic solvent is removed from the emulsified dispersion element (reaction product) and the reaction product is cleaned and dried to get the parent toner particles.

For removing the organic solvent, the temperature is gradually increased while stirring a laminar flow of the entire reaction product. After strongly stirring the reaction product at a fixed temperature range, the organic solvent is removed and the spindle shaped parent toner particles can be formed. Further, if a chemical such as a calcium phosphate salt which is soluble in acids and alkalies is used as a dispersion stabilizer, the calcium phosphate salt is dissolved using an acid such as hydrochloric acid and the resulting solution is washed with water to remove the calcium phosphate salt from the toner particles. Further, the calcium phosphate salt can also be removed using an operation such as enzymatic breakdown.

The electric charge controller is added to the parent toner particles that are obtained using the method mentioned earlier, and the inorganic particles such as silica particles and titanium oxide particles are externally added to get the toner.

Addition of the electric charge controller and external addition of the inorganic particles is carried out by a commonly known method that uses a mixer.

Due to this, the toner having a small particle diameter and a sharp particle diameter distribution can be easily obtained. Further, due to strong stirring during the process to remove the organic solvent, a shape of the toner particles can be controlled to a shape between a spherical shape and a rugby ball shape. Further, a surface morphology of the toner particles can also be controlled to between smooth and corrugated.

The shape of the toner is substantially sphere, and defined as follows.

Figure 9A:
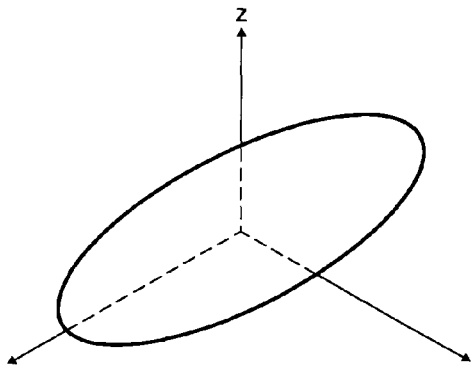
FIGS. 9A to 9C are schematic diagrams for explaining correlation among long axis, short axis, and thickness of toner that can be used in the image forming apparatus shown in FIG. 1.
Figure 9B:
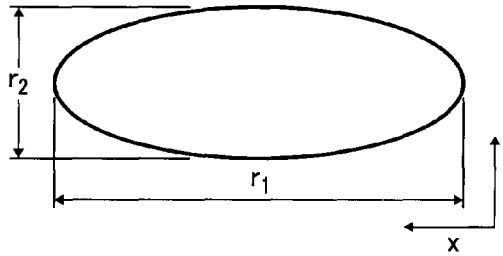
Figure 9C:
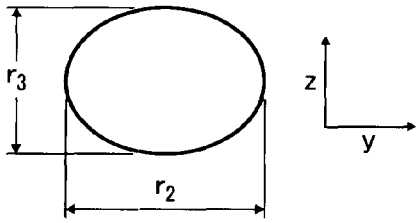

FIGS. 9A to 9C are schematic diagrams for explaining the shape of the toner. Assume now that long axis of the toner is r1, short axis r2, and thickness r3 (r1≧r2≧r3). It is preferable to set ratio between r1 and r2 (r2/r1) in a range between 0.5 and 1.0 with reference to FIG. 9B. Furthermore, it is preferable to set ratio between r3 and r2 (r3/r2) in a range between 0.7 and 1.0 with reference to FIG. 9C.

If the ratio between r1 and r2 (r2/r1) is smaller than 0.5, the toner is not spherical, so that dot reproducibility and transferability decrease, resulting in failing to generate a high quality image. Furthermore, if the ratio between r3 and r2 (r3/r2) is smaller than 0.7, the toner is flat, so that it is difficult to realize high transferability as opposite to the spherical toner. When the ratio between r3 and r2 (r3/r2) is 1.0, the toner is a solid of rotation with any one of the axes r3 and r2 serving as the rotation axis, resulting in increasing flowability of toner.

The values of r1, r2, r3 are measured through observation by taking photographs from different directions by using a scanning electron microscope.

Although the embodiments are described above, the present invention is not thus limited, and can be applied to other modifications within a spirit and scope of the present invention described in the appended claims and their equivalents.

For example, an image carrier on which the lubricant is supplied and spread can be photosensitive drums, such as the photosensitive drums 20Y, 20M, 20C, 20BK, instead of the intermediate transfer member such as the transfer belt 11. In this case, the lubricant applying device is arranged to the image carrier in the same manner as with the lubricant applying device 81.

The lubricant applying device can be individually arranged outside the cleaning device instead of being installed in the cleaning device regardless of type of the image carrier, i.e., regardless of the intermediate transfer member or the photosensitive drum. Furthermore, it is possible configure the lubricant applying device to spread the lubricant onto the secondary transfer belt 65 in the secondary transfer device 5 according to the embodiment.

The lubricant applying device can also include a position adjusting unit that adjusts the position of the lubricant to be applied onto the applying member in consideration with the inclination of the lubricant. In this case, the position adjusting unit adjusts the position of the lubricant by adjusting the holding member so that the lubricant is positioned on a preferable position for realizing effective use of the lubricant on an upstream side of the applying member in the rotation direction.

Although it is explained in the embodiment that binary developer is used, one-component developer can also be used. The present invention can be applied to an image forming apparatus in an one-drum type, in which a color image is generated by sequentially superimposing toner images of each color onto a single photosensitive drum, in addition to the tandem type image forming apparatus, such as the image forming apparatus 100. Furthermore, the present invention can be applied to a monochrome image forming apparatus instead of a color image forming apparatus. In each type of the image forming apparatuses, it is possible to directly transfer the toner images for each color onto a transfer paper and the like without using the intermediate transfer member.

According to an aspect of the present invention, use efficiency of the lubricant can be maintained, and the lubricant can be easily and stably spread with appropriate amount due to configuration in which a corner portion having curved surface comes into contact with the lubricant applying device. Therefore, it is possible to increase economic efficiency and lifetime of the lubricant. As a result, it is possible to provide a lubricant applying device that increases the lifetime of an image carrier, and forms an image in a desired quality.

According to another aspect of the present invention, when the corner portions of the lubricant have curved surfaces, one of the corner portions comes into contact with the applying unit when setting the lubricant applying device to which the lubricant is set, or when changing the lubricant. Therefore, it is possible to provide a lubricant applying unit that can be easily set without considering a direction of the lubricant.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A lubricant applying device configured for use in an image forming apparatus, the lubricant applying device comprising:

a lubricant in a solid form and configured to be coated on an image carrier of the image forming apparatus; and a rotating member that rotates while in contact with the lubricant, receives the lubricant, and applies the lubricant to the image carrier, wherein the lubricant has an upstream side and a downstream side with respect to a direction of rotation of the rotating member, a center portion of the lubricant on a side in contact with the rotating member between the upstream side and the downstream side is rounded forming a convex shape toward the rotating member, a corner portion of the upstream side of the lubricant has rounded edges forming a convex shape, a corner portion of the downstream side of the lubricant has rounded edges forming a convex shape, and the convex shapes of the corner portion of the upstream side and the corner portion of the downstream side are symmetric.

2. The lubricant applying device according to claim 1, wherein a radius of curvature of the center portion is larger than a radius of the rotating member.

3. The lubricant applying device according to claim 1, further comprising a holding member configured to hold the lubricant, wherein the holding member rotatably holds the lubricant around a center of curvature of the center portion.

4. The lubricant applying device according to claim 3, further comprising a guide member configured to guide the lubricant in a direction to come into contact with and away from the rotating member, wherein the guide member guides the lubricant at positions of a center point in a direction toward an axis of rotation of the rotating member and at least two portions symmetric to the center point.

5. A lubricant applying device configured for use in an image forming apparatus, the lubricant applying device comprising:

a lubricant in a solid form and configured to be coated on an image carrier of the image forming apparatus; and a rotating member configured to rotate while in contact with the lubricant, receives the lubricant, and applies the lubricant to the image carrier, wherein a center portion of the lubricant on a side in contact with the rotating member between the upstream side and the downstream side is rounded forming a convex shape toward the rotating member, and a corner portion of the upstream side of the lubricant that is closest to the rotating unit has rounded edges forming a convex shape, a corner portion of the downstream side of the lubricant has rounded edges forming a convex shape, and the convex shapes of the corner portion of the upstream side and the corner portion of the downstream side are symmetric.

6. The lubricant applying device according to claim 5, wherein a radius of curvature of the center portion is larger than a radius of the rotating member.

7. The lubricant applying device according to claim 5, further comprising a holding member configured to hold the lubricant, wherein the holding member rotatably holds the lubricant around a center of curvature of the center portion.

8. The lubricant applying device according to claim 7, further comprising a guide member configured to guide the lubricant in a direction to come into contact with and away from the rotating member, wherein the guide member guides the lubricant at positions of a center point in a direction toward an axis of rotation of the rotating member and at least two portions symmetric to the center point.

9. An image forming apparatus, comprising:

an image carrier for carrying an image;

a lubricant in a solid form and configured to be coated on the image carrier; and a rotating member that rotates while in contact with the lubricant, receives the lubricant, and applies the lubricant to the image carrier, wherein the lubricant has an upstream side and a downstream side with respect to direction of rotation of the rotating member, a center portion of the lubricant on a side in contact with the rotating member between the upstream side and the downstream side is rounded forming a convex shape toward the rotating member, and a corner portion of the upstream side of the lubricant has rounded edges forming a convex shape, a corner portion of the downstream side of the lubricant has rounded edges forming a convex shape, and the convex shapes of the corner portion of the upstream side and the corner portion of the downstream side are symmetric.

10. The image forming apparatus according to claim 9, wherein a radius of curvature of the center portion is larger than a radius of the rotating member.

11. The image forming apparatus according to claim 9, further comprising a holding member configured to hold the lubricant, wherein the holding member rotatably holds the lubricant around a center of curvature of the center portion.

12. The image forming apparatus according to claim 11, further comprising a guide member configured to guide the lubricant in a direction to come into contact with and away from the rotating member, wherein the guide member guides the lubricant at positions of a center point in a direction toward an axis of rotation of the rotating member and at least two portions symmetric to the center point.

* * * * *